US011384494B2

(12) United States Patent
Groeneweg

(10) Patent No.: US 11,384,494 B2
(45) Date of Patent: Jul. 12, 2022

(54) SAFETY TRAILER

(71) Applicant: Concaten, Inc., Golden, CO (US)

(72) Inventor: Kevin K. Groeneweg, Golden, CO (US)

(73) Assignee: Concaten, Inc., Golden, CO (US)

( * ) Notice: Subject to any disclaimer, the term of this patent is extended or adjusted under 35 U.S.C. 154(b) by 0 days.

(21) Appl. No.: 16/817,231

(22) Filed: Mar. 12, 2020

(65) Prior Publication Data

US 2020/0208363 A1 Jul. 2, 2020

Related U.S. Application Data

(63) Continuation of application No. 16/421,350, filed on May 23, 2019, which is a continuation of application No. 15/665,948, filed on Aug. 1, 2017, now Pat. No. 10,301,787, which is a continuation of application No. 15/019,124, filed on Feb. 9, 2016, now Pat. No. 9,725,858, which is a continuation of application No. 14/324,720, filed on Jul. 7, 2014, now Pat. No. 9,267,250, which is a continuation of application No. 14/106,039, filed on Dec. 13, 2013, now Pat. No. 8,777,255, which is a continuation of application No. 13/913,868, filed on Jun. 10, 2013, now Pat. No. 8,628,110, which is a continuation of application No. 12/713,822, filed on Feb. 26, 2010, now Pat. No. 8,465,047.

(60) Provisional application No. 61/156,319, filed on Feb. 27, 2009.

(51) Int. Cl.
*E01F 15/14* (2006.01)

(52) U.S. Cl.
CPC ..... *E01F 15/148* (2013.01); *E01F 15/14* (2013.01); *E01F 15/145* (2013.01)

(58) Field of Classification Search
CPC ..... E01F 15/148; E01F 15/14; E01F 15/145
See application file for complete search history.

(56) References Cited

U.S. PATENT DOCUMENTS

| | | | |
|---|---|---|---|
| 431,657 | A | 7/1890 | Hale |
| 3,120,398 | A | 2/1964 | Butterworth |
| 3,326,099 | A | 6/1967 | Cova et al. |
| 3,734,540 | A | 5/1973 | Thiermann |
| 3,774,940 | A | 11/1973 | Merritts |
| 3,952,453 | A | 4/1976 | Amburgey |
| 3,990,532 | A | 11/1976 | Robinson |
| 4,017,200 | A | 4/1977 | Woods, Jr. |

(Continued)

FOREIGN PATENT DOCUMENTS

| | | |
|---|---|---|
| DE | 806760 | 6/1951 |
| GB | 860338 | 2/1961 |
| WO | WO 93/12300 | 6/1993 |

OTHER PUBLICATIONS

Texas Transportation Institute, "Development of Functional Requirements for a Highly-Mobile Barrier System to Protect Highway Workers: Interim Report—Draft", May 2004, pp. 1-45.

(Continued)

*Primary Examiner* — Jacob D Knutson
(74) *Attorney, Agent, or Firm* — Carl A. Hjort, III

(57) ABSTRACT

The present invention is directed to differing embodiments of safety trailers, which have first and second platforms and a safety wall positioned therebetween. The platforms and safety wall define an area protected from vehicular incursions.

10 Claims, 28 Drawing Sheets

(56) References Cited

U.S. PATENT DOCUMENTS

| | | | | |
|---|---|---|---|---|
| 4,060,255 | A | 11/1977 | Zimmermann | |
| 4,087,785 | A | 5/1978 | Dodich | |
| 4,240,647 | A * | 12/1980 | Lewis | B60D 1/155 280/404 |
| 4,385,771 | A * | 5/1983 | Eckels | B60Q 1/305 280/400 |
| 4,406,563 | A | 9/1983 | Urlberger | |
| 4,600,178 | A | 7/1986 | Zucker et al. | |
| 4,601,509 | A | 7/1986 | Ellis, Sr. | |
| 4,624,601 | A | 11/1986 | Quittner | |
| 4,666,332 | A | 5/1987 | Burgett | |
| 4,681,302 | A | 7/1987 | Thompson | |
| 4,729,486 | A | 3/1988 | Petzo et al. | |
| 4,773,629 | A | 9/1988 | Yoduck | |
| 4,869,617 | A | 9/1989 | Chiodo | |
| 4,946,306 | A | 8/1990 | Yoduck | |
| 5,007,763 | A | 4/1991 | Burgett | |
| 5,011,325 | A | 4/1991 | Antonioli | |
| 5,033,905 | A | 7/1991 | Schmidt et al. | |
| 5,057,820 | A | 10/1991 | Markson et al. | |
| 5,088,874 | A | 2/1992 | Quittner | |
| 5,101,927 | A | 4/1992 | Murtuza | |
| 5,104,254 | A | 4/1992 | Durand | |
| 5,104,255 | A | 4/1992 | Bodensohn | |
| 5,123,773 | A | 6/1992 | Yoduck | |
| 5,208,585 | A | 5/1993 | Sprague | |
| 5,286,136 | A | 2/1994 | Mandish et al. | |
| 5,292,467 | A | 3/1994 | Mandish et al. | |
| 5,336,016 | A | 8/1994 | Baatz | |
| 5,387,049 | A | 2/1995 | Duckett | |
| 5,425,594 | A | 6/1995 | Krage et al. | |
| 5,480,255 | A | 1/1996 | Bernaquez et al. | |
| 5,498,101 | A | 3/1996 | Braverman | |
| 5,531,540 | A | 7/1996 | Wasserstrom et al. | |
| 5,611,641 | A | 3/1997 | Christensen | |
| 5,688,071 | A | 11/1997 | Owen | |
| 5,833,294 | A | 11/1998 | Williams | |
| 5,836,714 | A | 11/1998 | Christensen | |
| 5,947,452 | A | 9/1999 | Albritton | |
| 5,988,934 | A | 11/1999 | Wasserstrom | |
| 6,098,767 | A | 8/2000 | Unrath | |
| 6,183,042 | B1 | 2/2001 | Unrath | |
| 6,213,047 | B1 | 4/2001 | Means et al. | |
| 6,220,780 | B1 | 4/2001 | Schindler et al. | |
| 6,231,065 | B1 * | 5/2001 | Brown | B60D 1/155 180/7.1 |
| 6,349,517 | B1 | 2/2002 | Manley et al. | |
| 6,371,505 | B1 | 4/2002 | Turner, II | |
| 6,409,417 | B1 | 6/2002 | Muller et al. | |
| 6,450,522 | B1 | 9/2002 | Yamada et al. | |
| 6,523,872 | B2 | 2/2003 | Breed | |
| 6,565,108 | B1 | 5/2003 | Gearhart | |
| 6,581,992 | B1 | 6/2003 | Gertz | |
| 6,669,402 | B1 | 12/2003 | Davis | |
| 6,863,468 | B2 | 3/2005 | Davis et al. | |
| 6,926,461 | B1 | 8/2005 | Faller et al. | |
| 6,942,263 | B2 | 9/2005 | Welch et al. | |
| 7,125,198 | B2 * | 10/2006 | Schiefferly | E01F 15/006 404/6 |
| 7,354,218 | B1 | 4/2008 | Dyke et al. | |
| 7,410,321 | B1 * | 8/2008 | Schiefferly | E01F 15/148 404/6 |
| 7,572,022 | B2 * | 8/2009 | Groeneweg | B60P 3/00 362/458 |
| 7,607,873 | B2 * | 10/2009 | Wehrli | B60P 3/002 410/32 |
| 2007/0012534 | A1 | 1/2007 | Murphy | |
| 2009/0166998 | A1 * | 7/2009 | Groeneweg | E01F 15/006 280/408 |
| 2009/0290324 | A1 | 11/2009 | Groeneweg | |
| 2009/0311044 | A1 * | 12/2009 | Groeneweg | E01F 15/088 404/6 |
| 2010/0101156 | A1 | 4/2010 | Holroyd | |

OTHER PUBLICATIONS

Beason, et al., "Development of a Truck-Mounted Portable Maintenance Barrier", Research Report No. 262-5, Research Study No. 2-18-79-262, Safety Devices for Highway Work Zones, Texas Transportation Institute, Apr. 1984, pp. 1-82.

International Search Report for International (PCT) Patent Application No. PCT/US2010/025613, dated Apr. 23, 2010.

Written Opinion for International (PCT) Patent Application No. PCT/US2010/025613, dated Apr. 23, 2010.

Background of the above-referenced Application filed Feb. 26, 2010 (previously provided).

International Preliminary Report on Patentability for PCT Application No. PCT/US08/88668, dated Dec. 23, 2010.

International Search Report for PCT Application No. PCT/US08/88668, dated Jun. 1, 2009.

Written Opinion for PCT Application No. PCT/US08/88668, dated Jun. 1, 2009.

* cited by examiner

SAFETY TRAILER

CROSS REFERENCE TO RELATED APPLICATION

The present application is a continuation of U.S. application Ser. No. 16/421,350, filed May 23, 2019, which is a continuation of U.S. application Ser. No. 15/655,948, filed Aug. 1, 2017, now U.S. Pat. No. 10,301,787, which is a continuation of U.S. application Ser. No. 15/019,124, filed Feb. 9, 2016, now U.S. Pat. No. 9,725,858, which is a continuation of U.S. application Ser. No. 14/324,720, filed Jul. 7, 2014, now U.S. Pat. No. 9,267,250, which is a continuation of U.S. application Ser. No. 14/106,039, filed Dec. 13, 2013, now U.S. Pat. No. 8,777,255, which is a continuation of U.S. application Ser. No. 13/913,868, filed Jun. 10, 2013, now U.S. Pat. No. 8,628,110 which is a continuation of U.S. application Ser. No. 12/713,822, filed Feb. 26, 2010, now U.S. Pat. No. 8,465,047 which claims the benefits of U.S. Provisional Application Ser. No. 61/156,319, filed Feb. 27, 2009, all having the same title, all of which are incorporated herein by this reference.

FIELD

The present invention relates generally to the field of trailers and other types of barriers used to shield road construction workers from traffic. More specifically, the present invention discloses a safety and construction trailer having a safety wall.

BACKGROUND

Various types of barriers have long been used to protect road construction workers from passing vehicles. For example, cones, barrels and flashing lights have been widely used to warn drivers of construction zones, but provide only limited protection to road construction workers in the event a driver fails to take heed. Some construction projects routinely park a truck or other heavy construction equipment in the lane between the construction zone and on-coming traffic. This reduces the risk of worker injury from traffic in that lane, but does little with regard to errant traffic drifting laterally across lanes into the construction zone. In addition, conventional barriers require significant time and effort to transport to the work site, and expose workers to significant risk of accident while deploying the barrier at the work site. Therefore, a need exists for a safety barrier that can be readily transported to and deployed at the work site. In addition, the safety barrier should protect against lateral incursions by traffic from adjacent lanes, as well as traffic in the same lane.

SUMMARY

These and other needs are addressed by the various embodiments and configurations of the present invention.

In one aspect, a system is provided that includes first and second platforms comprising at least one set of wheels and a safety wall positionable between the first and second platforms to define an area protected from a vehicular incursion. The system further includes one or more of the following features:

(A1) the safety wall rotates, by first and second arms, to either side of the first and second platforms, wherein the safety wall has a height of at least about 4 feet from bottom edge to top edge;

(A2) the safety wall has a height that is substantially the same as a width of at least one of the first and second platforms, wherein the width ranges from about 6 to about 12 feet;

(A3) a weight of the safety wall is at least partially offset by a ballast that is movable, along a fixed path, from one side of the first and/or second platform to the other side;

(A4) the safety wall rotates upwardly from a substantially horizontal position to a substantially vertical position;

(A5) the safety wall rotates downwardly from a substantially horizontal position to a substantially vertical position, wherein an axis of rotation of the safety wall is horizontally offset from a longitudinal axis of the first and second platforms;

(A6) the safety wall rotates counter-clockwise from a substantially horizontal position to a substantially vertical position;

(A7) the safety wall moves from a first side of the first and second platforms to an opposing second side, wherein a first surface of the safety wall faces outwardly when the safety wall is positioned on the first side and a different second surface of the safety wall faces outwardly when the safety wall is positioned on the second side;

(A8) the safety wall is segmented, with each segment being rotatable with respect to an adjoining segment;

(A9) the first platform comprises an asphalt roller to engage a road surface when the safety wall is deployed;

(A10) the safety wall moves vertically from a first undeployed position to a second deployed position, the vertical movement being directed by a guide mechanism engaging the safety wall and an adjacent one of the first and second platform;

(A11) an inclination of the safety wall, relative to vertical, is adjusted about a substantially stationary point on the safety wall;

(A12) the safety wall is displaced linearly from a first side of the first and second platforms to a second side of the first and second platforms;

(A13) the safety wall comprises first and second segments, the segments being slidably, but not telescopically, engaged with one another;

(A14) the safety wall slidably engages at least one of the first and second platforms;

(A15) the safety wall comprises first and second segments, the segments having first and second sets of holes, respectively, oriented transversely to an exteriorly facing surface of the safety wall, the holes, when aligned, receive dowels to lock the first and second segments in position relative to one another; and (A16) at least one of the first and second platforms and the safety wall comprise a guide mechanism that directs the safety wall into a desired position.

In a further aspect, a method is provided that includes:

(a) providing first and second platforms, comprising at least one set of wheels, and a safety wall positionable between the first and second platforms to define an area protected from a vehicular incursion; and (b) performing at least one of the following steps:

(B1) rotating the safety wall, by first and second arms, to either side of the first and second platforms, wherein the safety wall has a height of at least about 4 feet from bottom edge to top edge;

(B2) positioning the safety wall on a side of the first and second platforms, the safety wall having a height that is substantially the same as a width of at least one of the first and second platforms, wherein the width ranges from about 6 to about 12 feet;

(B3) moving a ballast along a fixed path from one side of the first and/or second platform to the other side to at least partially offset a weight of the safety wall;

(B4) rotating the safety wall upwardly from a substantially horizontal position to a substantially vertical position;

(B5) rotating the safety wall downwardly from a substantially horizontal position to a substantially vertical position, wherein an axis of rotation of the safety wall is horizontally offset from a longitudinal axis of the first and second platforms;

(B6) rotating the safety wall counter-clockwise from a substantially horizontal position to a substantially vertical position;

(B7) moving the safety wall from a first side of the first and second platforms to an opposing second side, wherein a first surface of the safety wall faces outwardly when the safety wall is positioned on the first side and a different second surface of the safety wall faces outwardly when the safety wall is positioned on the second side;

(B8) positioning the safety wall on a side of the first and second platforms, the safety wall being segmented, with each segment being rotatable with respect to an adjoining segment;

(B9) when the safety wall is deployed, engaging a road surface with an asphalt roller on the first platform;

(B10) moving the safety wall vertically from a first undeployed position to a second deployed position, the vertical movement being directed by a guide mechanism engaging the safety wall and an adjacent one of the first and second platform;

(B11) adjusting an inclination of the safety wall, relative to vertical, about a substantially stationary point on the safety wall;

(B12) displacing the safety wall linearly from a first side of the first and second platforms to a second side of the first and second platforms;

(B13) positioning the safety wall on a side of the first and second platforms, the safety wall comprising first and second segments, the segments being slidably, but not telescopically, engaged with one another;

(B14) positioning the safety wall on a side of the first and second platforms, the safety wall slidably engaging at least one of the first and second platforms;

(B15) positioning the safety wall on a side of the first and second platforms, the safety wall comprising first and second segments, the segments having first and second sets of holes, respectively, oriented transversely to an exteriorly facing surface of the safety wall, the holes, when aligned, receive dowels to lock the first and second segments in position relative to one another; and (B16) positioning the safety wall on a side of the first and second platforms, at least one of the first and second platforms and the safety wall comprising a guide mechanism to direct the safety wall into a desired position.

The present invention can provide a number of advantages depending on the particular configuration. By way of example, the safety trailer can have sufficient mass and energy absorption to resist, without substantial displacement, the kinetic energy from the impact. The safety wall itself can be made of any rigid material, such as steel. Lighter weight materials having high strength are typically disfavored as their reduced weight is less able to withstand, without significant displacement, the force of a vehicular collision. Energy absorption can be provided by shocks and inflated wheels. Preferred trailer configurations are not deployed on jack stands, which can minimize energy absorption by these mechanisms.

The safety wall or barrier (and thus the entire trailer) can be of any selected length or extendable to provide a work area protected from vehicular incursions. This can provide maintenance workers with substantial safety benefits while also providing enhanced driver safety.

The traffic-incursion side of the safety trailer, including any elongated safety wall, can be substantially planar to avoid hang ups and snags with an impacting vehicle. Hang ups and snags can direct more kinetic impact energy into the wall and/or cause the vehicle to flip over the safety wall.

The height of the safety wall can be high enough to inhibit entry of an impacting vehicle into the protected work area by climbing, flipping, and careening over the wall.

End platforms integral to the trailer's design can minimize the need for workers to leave the protected zone and eliminate the need for separate maintenance vehicles by providing onboard hydraulics, compressors, generators and related power, fuel, water, storage and portable restroom facilities.

Optional overhead protection can be extended out over the work area for even greater environmental relief (rain or shine).

The trailer can carry independent directional and safety lighting at both ends and will work with any standard semi tractor. Directional lighting and impact-absorbing features incorporated at each end of the trailer and in the rear platform can combine with the safety wall and improved lighting to provide increased protection for both work crews and the public, especially with ever-increasing amounts of night-time construction. Optionally, an impact-absorbing caboose can be attached at the end of the trailer opposite the tractor to provide additional safety lighting and impact protection.

The trailer can be designed to eliminate the need for separate lighting trucks or trailers, to reduce glare to traffic, to eliminate the need for separate vehicles pulling portable restroom facilities, to provide better a brighter, more controlled work environment and enhanced safety, and to, among other things, better facilitate 24-hour construction along the nation's roadways.

The trailer can be designed to provide road maintenance personnel with improved protection from ongoing, oncoming and passing traffic, to reduce the ability of passing traffic to see inside the work area (to mitigate rubber-necking and secondary incidents), and to provide a fully-contained, mobile, enhanced environment within which the work crews can function day or night, complete with optional power, lighting, ventilation, heating, cooling, and overhead protection including extendable mesh shading for sun protection, or tarp covering for protection from rain, snow or other inclement weather.

Platforms can be provided at both ends of the trailer for hydraulics, compressors, generators, batteries, water misters, water sprayers, pumps for liquid removal from the protected work area, fans, tool storage, related fuel, water, storage, and restroom facilities and other amenities. The trailer can be fully rigged with direction and safety lighting, as well as lighting for the work area and platforms. Power outlets can be provided in the interior of the work area for use with construction tools and equipment, with minimal need for separate power trailers or extended cords. Both the front and rear platforms can provide areas for fuel, water and storage. Additional fuel, water and miscellaneous storage space can be provided in an optional extended caboose of like but lengthened design.

Other applications include but are not limited to public safety, portable shielding and shelter, communications and public works. Two or more trailers can be used together to provide a fully enclosed inner area, such as may be necessary in multi-lane freeway environments.

With significant shifts to night construction and maintenance, the trailer can provide a well-lit, self-contained, and mobile safety enclosure. Cones can still be used to block lanes, and detection systems or personnel can be used to provide notice of an errant driver, but neither offers physical protection or more than split second warning for drivers who may be under the influence of alcohol or intoxicants, or who, for whatever reason, become fixated on the construction/maintenance equipment or lights and veer into or careen along the same.

The safety trailer can be readily, easily and conveniently deployable. The tractor can, for instance, be able to engage the hitch of the safety trailer from multiple directions, rather than only from one specific orientation. The safety trailer can have an air ride on the rear platform to permit either side or the entirety of the front and/or rear platforms to be raised or lowered.

The safety trailer can have semi-tractor hookups at both ends and a safety wall that is fixed to one side of the trailer. That side, however, can be changed to the right or left side of the road, depending on the end to which the semi-tractor attaches. A caboose can be attached at the end of the trailer opposite the tractor to provide additional lighting and impact protection.

These and other advantages will be apparent from the disclosure of the invention(s) contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present invention(s). These drawings, together with the description, explain the principles of the invention(s). The drawings simply illustrate preferred and alternative examples of how the invention(s) can be made and used and are not to be construed as limiting the invention(s) to only the illustrated and described examples. Further features and advantages will become apparent from the following, more detailed, description of the various embodiments of the invention(s), as illustrated by the drawings referenced below.

DETAILED DESCRIPTION

General

In designing a vehicular impact resistant safety trailer, there are a number of design considerations. For example, the safety trailer should have sufficient mass and energy absorption to resist, without substantial displacement, the kinetic energy from the impact. Energy absorption can be provided by shocks and inflated wheels. Deploying the trailer on jack stands can minimize energy absorption by these mechanisms. If there is insufficient mass and energy absorption, the vehicular impact can displace the safety trailer into the protected work area, with concomitant injuries to maintenance personnel. On the oncoming traffic-facing end of the trailer, the safety trailer should have crash attenuation devices to absorb energy from vehicular collisions and lighting and illuminated message boards to provide adequate warnings to drivers. The traffic-incursion side of the safety trailer, including any elongated safety wall, should be substantially planar to avoid hang ups and snags with an impacting vehicle. Hang ups and snags can direct more kinetic impact energy into the wall and/or cause the vehicle to flip over the safety wall. The safety wall, itself, should have sufficient structural strength (e.g., a relatively high tensile and compressive yield strength) and elastic deformation to resist the kinetic energy of vehicular impact. The height of the safety wall should be high enough to inhibit entry of an impacting vehicle into the protected work area by climbing, flipping, and careening over the wall. The safety trailer should have embedded equipment and associated plumbing/wiring to assist workers in the work area. Examples include generators, lighting, compressors, batteries, water misters, water sprayers, pumps for liquid removal from the protected work area, fans, tool storage, and the like. The safety trailer should be readily, easily and conveniently deployable. The tractor should, for instance, be able to engage the hitch of the safety trailer from multiple directions, rather than only from one specific orientation. The safety trailer should have an air ride on the rear platform to permit either side or the entirety of the front and/or rear platforms to be raised or lowered. The various configurations and embodiments disclosed herein have one or more of these features.

Rotatable Arm Safety Wall Trailer Designs

In a number of safety trailer embodiments, the safety wall rotates to either side of the trailer, by a rotatable arm aligned (in a substantially vertical plane) substantially with the longitudinal axis of the safety trailer. Each of the rotatable arms, when deploying the safety wall, can drop into, or engage, a channel and/or retainer to provide added strength to the safety wall.

Figure 1:
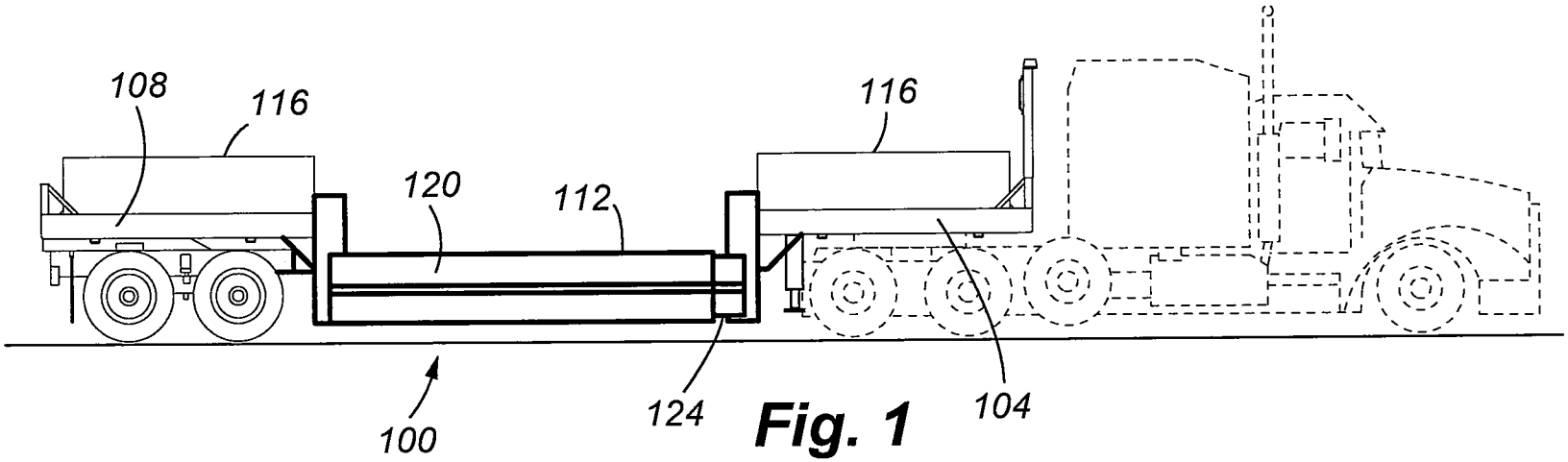
FIG. 1 is a side view of an undeployed safety trailer according to an embodiment.
Figure 2:
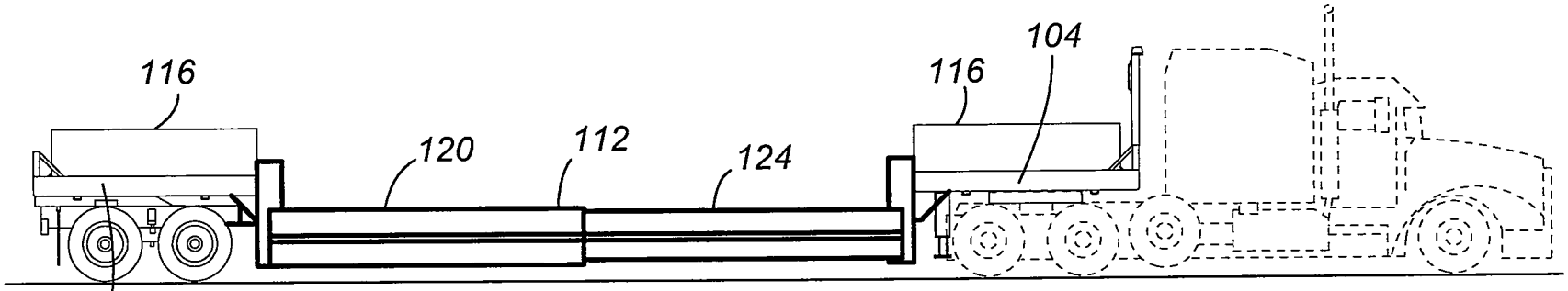
FIG. 2 is a side view of a deployed safety trailer according to the embodiment of FIG. 1.

FIGS. 1-2 depict a safety trailer according to an embodiment of this design. The trailer 100 includes first and second platforms 104 and 108 interconnected by an extendible and retractable safety wall 112. The safety wall 112 includes first and second sections 120 and 124, with the first section 120 telescopically receiving the second section 124. FIG. 1 depicts the safety wall in an undeployed configuration while FIG. 2 depicts the safety wall in a deployed configuration. In the undeployed configuration, the safety wall is retracted while in the deployed configuration the safety wall is extended to define a protected work area for maintenance personnel. The first and/or second platforms 104 and 108 each include a ballast 116, which is positioned on the trailer 100 to offset, at least substantially, the weight of the safety wall 112.

Figure 9:
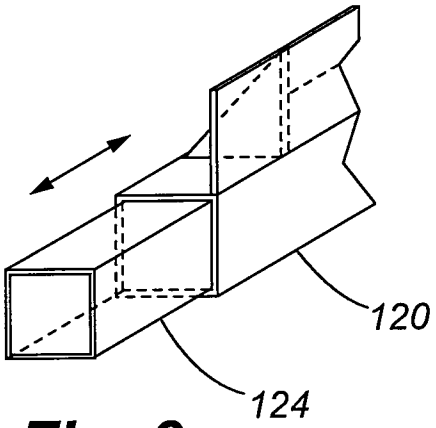
FIG. 9 is a telescopic tube-in-tube wall structure member according to an embodiment.
Figure 8:
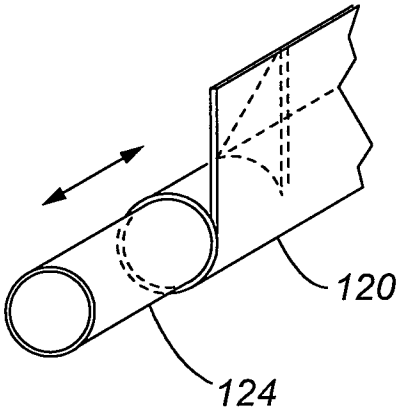
FIG. 8 is a telescopic tube-in-tube wall structure member according to an embodiment.
Figure 11:
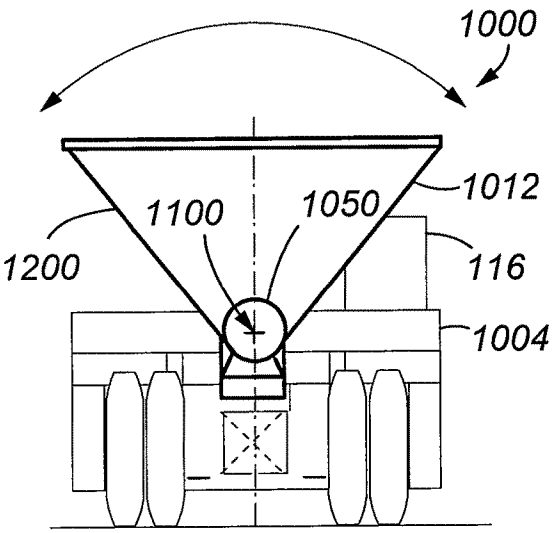
FIG. 11 is a cross sectional view of the deployed safety trailer taken along line 10-10 of FIG. 12 according to an embodiment with the wall structure being moved from the first side to a second side of the trailer.
Figure 10:
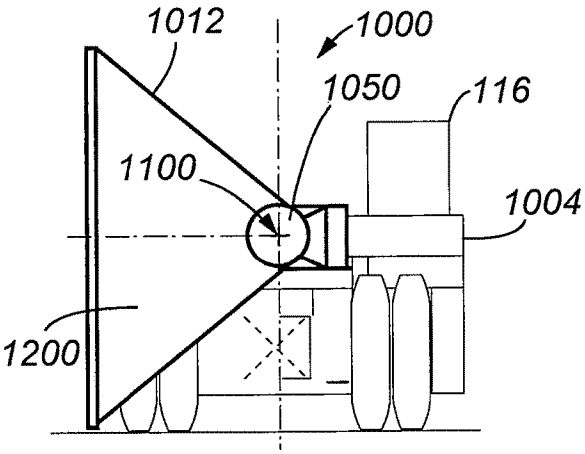
FIG. 10 is a cross sectional view of a deployed safety trailer taken along line 10-10 of FIG. 12 according to an embodiment with the wall structure on a first side of the trailer.
Figure 13:
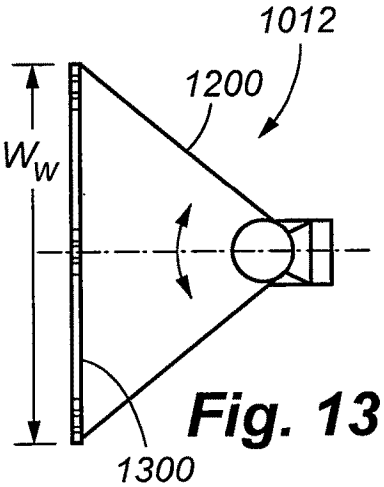
FIG. 13 is an isometric view of the safety trailer.
Figure 12:
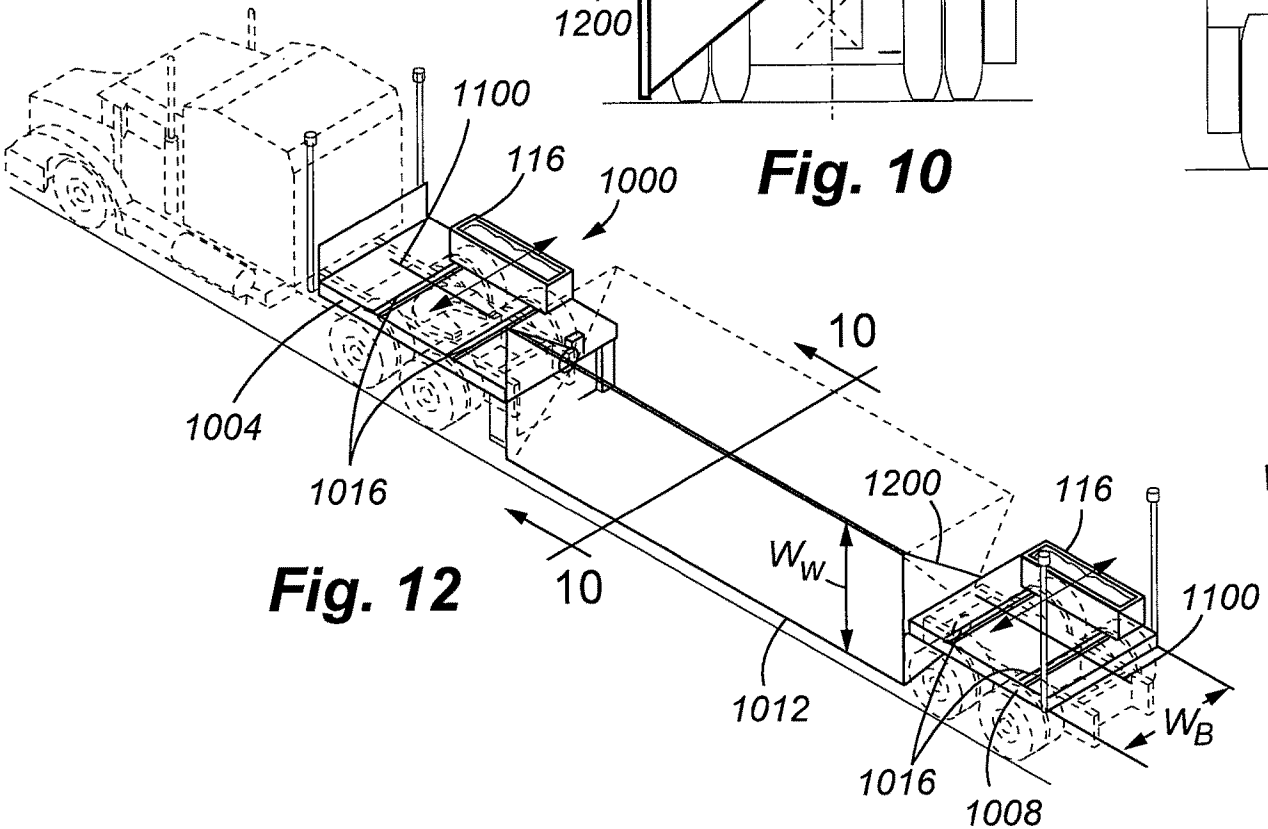
FIG. 12 is the wall structure in isolation of the safety trailer.

FIGS. 8 and 9 depict how the telescopically engaged first and second sections 120 and 124 of the safety wall 112 are extended and retracted. The safety wall includes a plurality of interconnected structural members, typically in the form of tubes. FIGS. 8 and 9 depict an exemplary structural member in the safety wall. Both figures depict a tube-in-tube arrangement with very tight clearance (e.g., less than about 5 mm) between the engaged tubes. FIG. 8 depicts a circular or arcuate structural tube cross section while FIG. 9 depicts a rectangular tube cross section.

Figure 5:
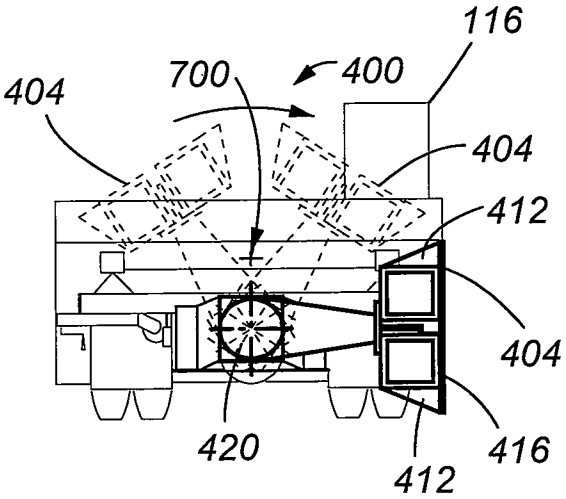
FIG. 5 is a cross sectional view along a latitudinal axis of a deployed safety trailer of FIG. 4 showing the wall structure positioned on an opposing second side of the safety trailer.
Figure 4:
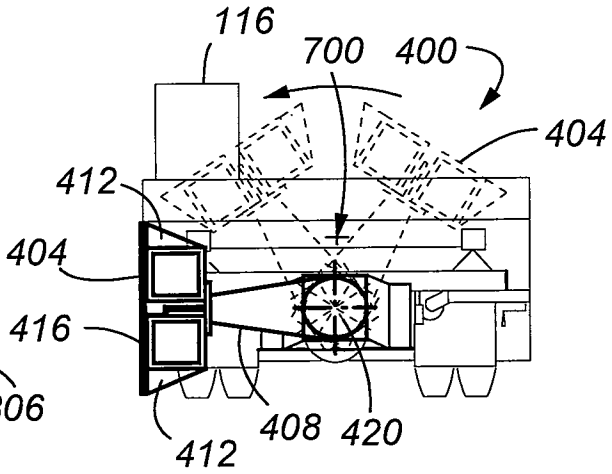
FIG. 4 is a cross sectional view along a latitudinal axis of a deployed safety trailer (the axis passing between the first and second platforms) according to an embodiment showing a wall structure positioned on a first side of the safety trailer.
Figure 3:
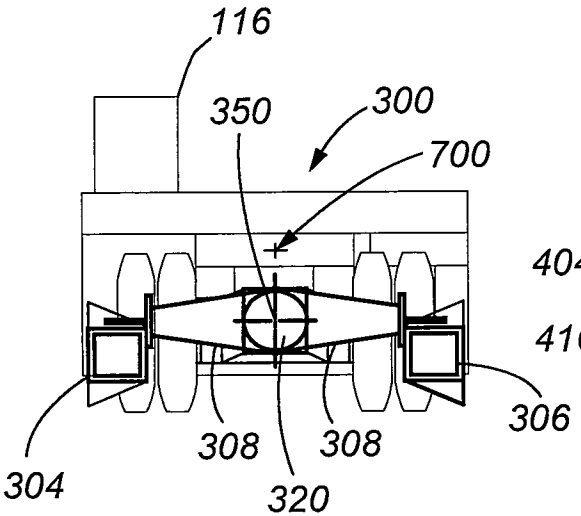
FIG. 3 is a cross sectional view along a latitudinal axis of a deployed safety trailer (the axis passing between the first and second platforms) according to an embodiment showing first and second wall structures positioned on either side of the safety trailer.

With reference to FIGS. 3-7, a number of possible safety wall deployed mechanisms are depicted for various trailer embodiments. In all of the mechanisms, the safety wall rotates, via a rotatable arm, about a rotation axis (in a substantially vertical plane containing also the longitudinal axis of the safety trailer) and the safety wall is expandable via a telescopic mechanism similar to that of FIGS. 1-2 and 8-9. FIG. 3 depicts a safety trailer 300 configuration with independently movable (rotatable) first and second safety walls 304 and 306. Each first and second safety wall 300 and 306 includes a pair of corresponding rotating arms 308, with a rotating arm of each wall 300 and 306 rotating about a common pivot 320, the rotational axis 350 of which lies in a vertical plane containing the longitudinal axis of the safety trailer 300. The ends of the walls 304 and 306 connect to a different pivot. The first and second safety walls 300 and 304 may be positioned one-on-top-of-the-other on a common side of the safety trailer 300 (not shown) to define a partially protected work space having ingress or egress to workers and equipment or on separate sides of the safety trailer 300, as shown in FIG. 3, to define a fully protected and enclosed work space between the walls. FIGS. 4-5 depict another safety trailer 400 configuration. The safety wall 404 is rotatable, by rotating arms 408 and about front and rear pivots 420, to either side of the safety trailer 400. The wall includes upper and lower gussets 412 to provide additional structural support to the exterior panel 416.

Figure 7:
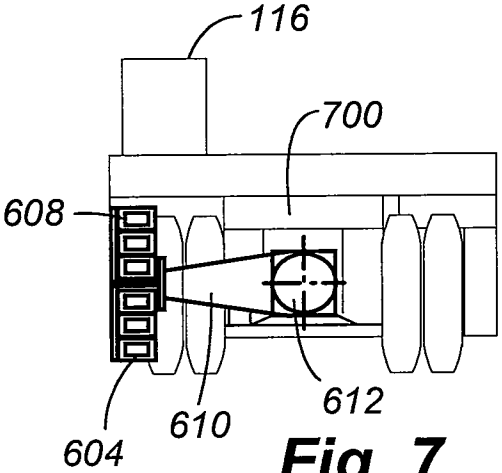
FIG. 7 is a cross sectional view along a latitudinal axis of a deployed safety trailer (the axis passing between the first and second platforms) according to an embodiment showing stackable first and second wall structures positioned on either side of the safety trailer.
Figure 6:
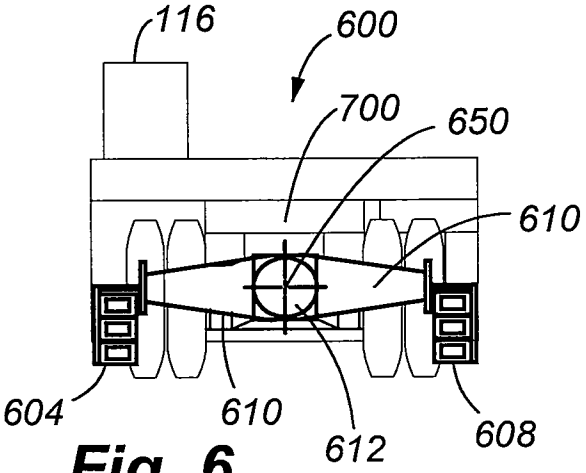
FIG. 6 is a cross sectional view along a latitudinal axis of a deployed safety trailer (the axis passing between the first and second platforms) according to an embodiment showing stackable first and second wall structures positioned on either side of the safety trailer.

FIGS. 6-7 show yet another safety trailer 600 design according to another embodiment. The safety trailer 600 includes first and second telescopically expandable and retractable safety walls 604 and 608 attached, by rotatable arms 610, to a common pivot 612, the rotational axis 650 of which typically is substantially parallel to, and may lie in a substantially vertical plane with, a longitudinal axis 700 of the safety trailer 600. The other ends of the walls 604 and 608 connect to a different common pivot, positioned, relative to pivot 612, to provide a common axis of rotation. FIG. 6 shows the first and second safety walls 604 and 608 being positioned, or deployed, on opposing sides of the safety trailer to define a fully enclosed and protected work space between the safety walls. FIG. 7 shows the first and second safety walls 604 and 608 stacked one-on-top-of-the-other to define a wall that is twice as high as each of the first and second safety walls 604 and 608 and a partially enclosed and protected work space.

FIGS. 10-13 depict a safety trailer 1000 configuration according to another embodiment. The safety trailer 1000 includes first and second platforms 1004 and 1008 and an intervening, rotatably positionable, safety wall 1012. Each of the first and second platforms 1004 and 1008 include ballast 116 that is movably positionable between the opposing first and second sides of the safety trailer 1000 via rails 1016. Typically, the ballast is positioned on the opposite side of the safety trailer 1000 from the deployed safety wall 1012. The safety wall 1012 includes first and second "V" shaped rotatable arms 1200, each rotatable arm 1200 being connected to a different pivot 1050 and having a traffic incursion facing panel 1300. The respective pivots 1050 of the first and second rotatable arms 1200 typically lie along a common rotation axis, which is generally the longitudinal axis 1100 of the safety trailer 1000. The width "W.sub.W" of the safety wall 1012 is preferably within about 25% of, more preferably within about 10% of, and even more preferably substantially the same as, the width "W.sub.B" of the bed of the safety trailer 1000. This width preferably is at least about 4 feet, more preferably at least about 6 feet and even more preferably ranges from about 6 to about 12 feet.

Flip Up/Down Safety Wall Trailer Designs

In a number of safety trailer embodiments, the safety wall flips up or down when deployed. In these embodiments, the axis of rotation of the safety wall is spatially offset from (to one side of) a longitudinal axis of the safety trailer. Stated another way, a plane containing both the axis of rotation of the safety wall and longitudinal axis of the safety trailer is not vertical but transverse to a vertical plane. In one configuration, the plane containing both axes is substantially horizontal.

Figure 15:
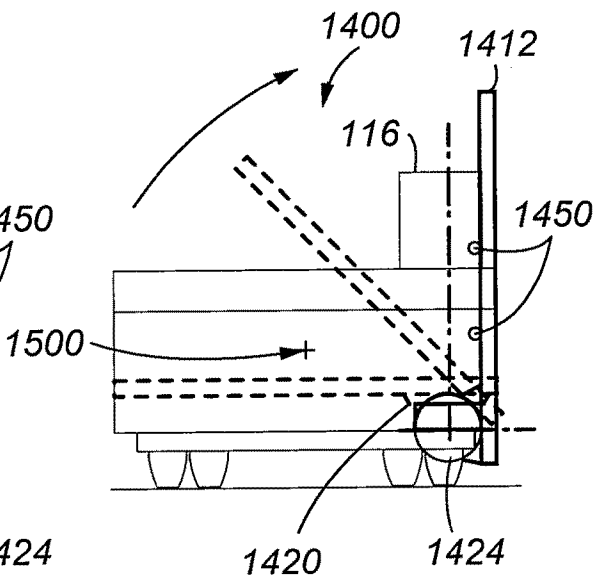
FIG. 15 is a cross sectional view of a deployed safety trailer taken along line 14-14 of FIG. 16 according to an embodiment with the wall structure being moved to a deployed position.
Figure 14:
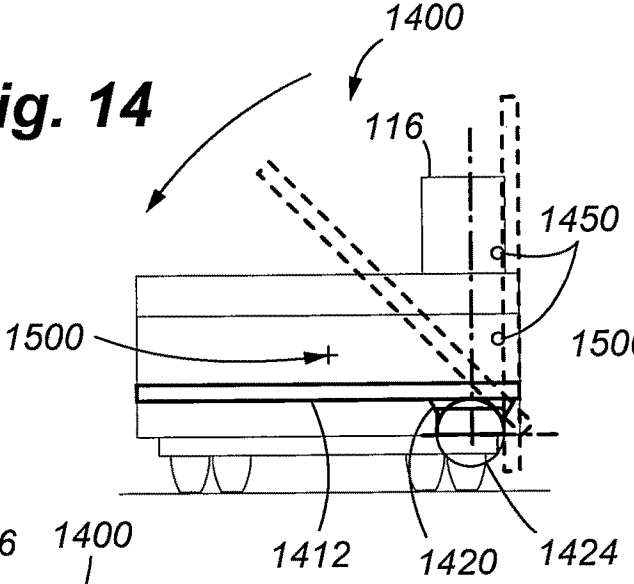
FIG. 14 is a cross sectional view of a deployed safety trailer taken along line 14-14 of FIG. 16 according to an embodiment with the wall structure being moved to an undeployed position.
Figure 16:
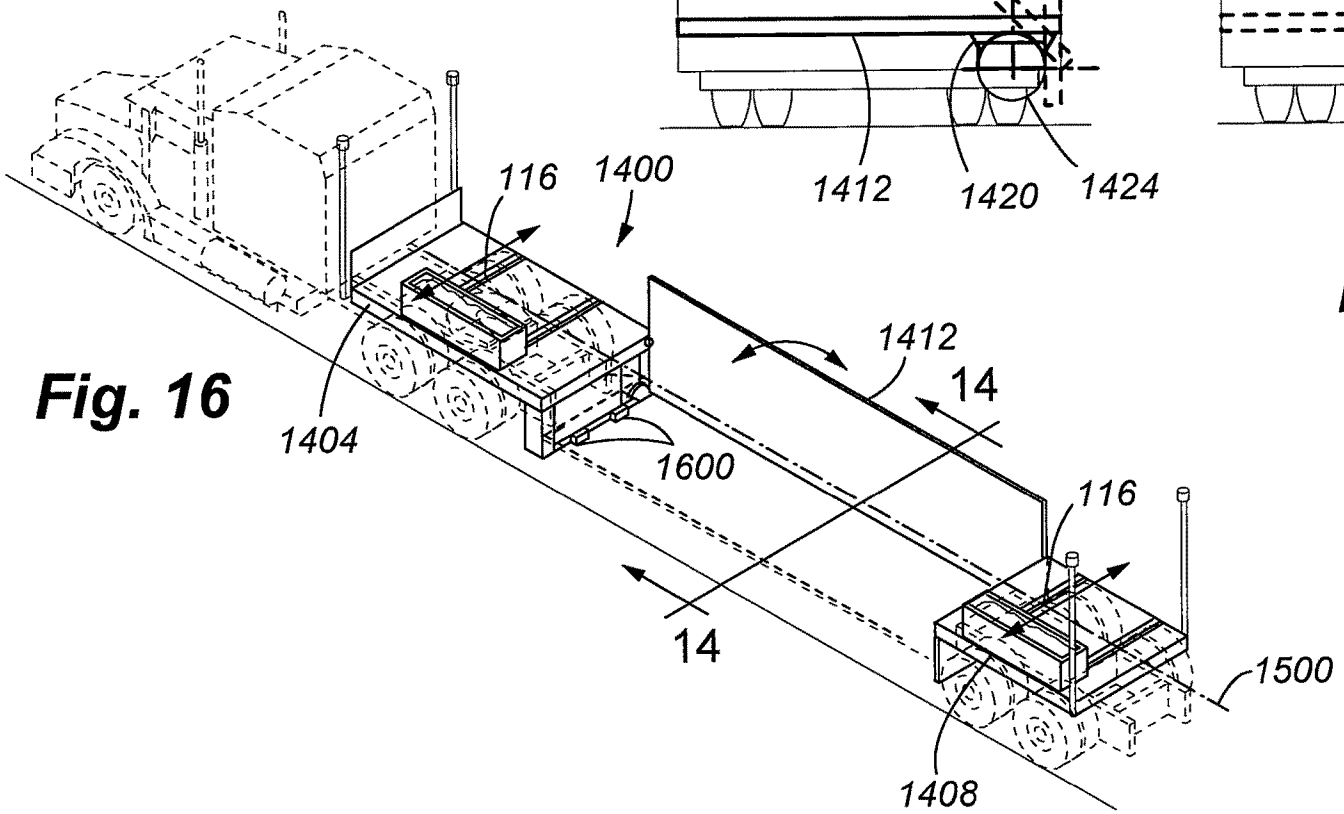
FIG. 16 is an isometric view of the safety trailer.

With reference to FIGS. 14-16, a safety trailer 1400 according to an embodiment of this design includes first and second platforms 1404 and 1408 with a safety wall 1412 rotatably engaged with, and positioned between, the platforms. As can be seen from FIGS. 14-15, each end of the safety wall engages, via a respective short rotatable arm 1420, a corresponding pivot 1424, about which the safety wall 1412 rotates upwards for deployment or downwards for undeployment/transit. An axis of rotation defined by the pivots 1424 is substantially parallel to, but is offset to one side of, a longitudinal axis 1500 of the trailer 1400. As can be seen in FIG. 16, the first and second platforms 1404 and 1408 each include protruding supports 1600 to support the wall when rotated downwards for transit. FIG. 14 further shows that the upper portion of the deployed wall can be supported/anchored by protruding pins or dowels 1450. The height of the deployed safety wall is substantially the same as the width of the trailer bed.

Figure 18:
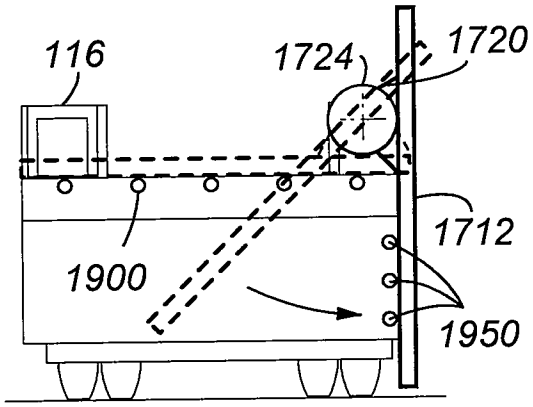
FIG. 18 is a cross sectional view of a deployed safety trailer taken along line 17-17 of FIG. 19 according to an embodiment with the wall structure being moved to a deployed position.
Figure 17:
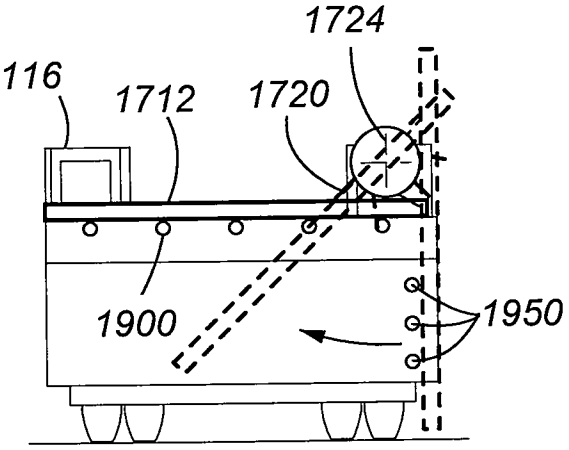
FIG. 17 is a cross sectional view of a deployed safety trailer taken along line 17-17 of FIG. 19 according to an embodiment with the wall structure being moved to an undeployed position.
Figure 19:
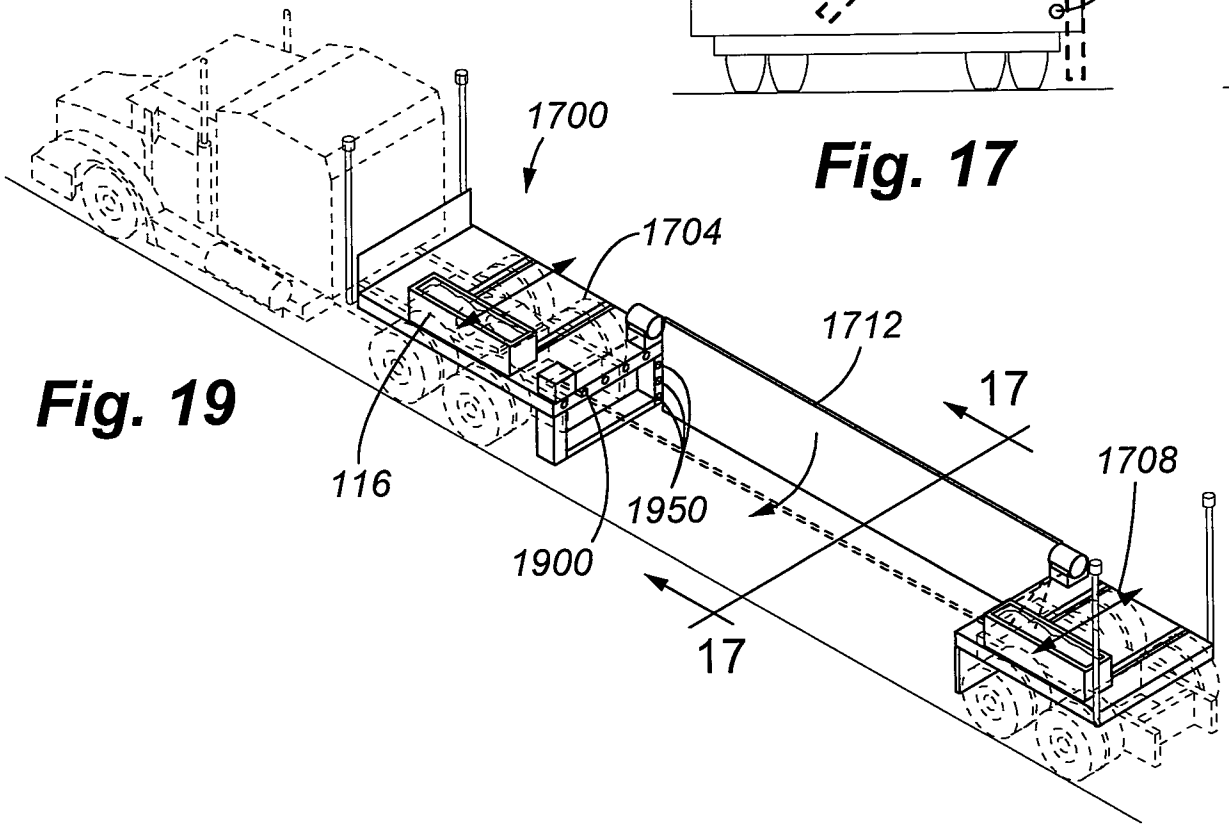
FIG. 19 is an isometric view of the safety trailer.

With reference to FIGS. 17-19, a safety trailer 1700 according to an embodiment includes first and second platforms 1704 and 1708 with a safety wall 1712 rotatably engaged with, and positioned between, the platforms. As can be seen from FIGS. 17-18, each end of the safety wall engages, via a respective short rotatable arm 1720, a corresponding pivot 1724, about which the safety wall 1712 rotates downwards for deployment or upwards for undeployment/transit. As can be seen in FIG. 19, the first and second platforms 1704 and 1708 each include a first set of holes 1900 for dowels to support the wall when rotated upwards for transit and a second set of holes 1950 for dowels to support the wall when deployed. The height of the deployed safety wall is substantially the same as the width of the trailer.

Figure 21:
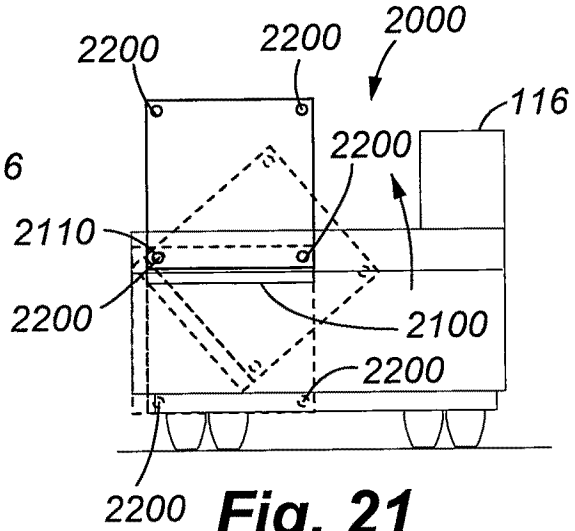
FIG. 21 is a cross sectional view of a deployed safety trailer taken along line 20-20 of FIG. 22 according to an embodiment with the wall structure being moved to an undeployed position.
Figure 20:
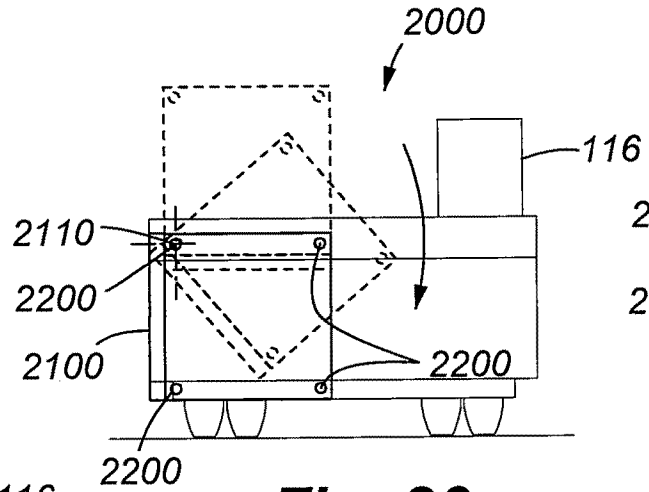
FIG. 20 is a cross sectional view of a deployed safety trailer taken along line 20-20 of FIG. 22 according to an embodiment with the wall structure being moved to a deployed position.
Figure 22:
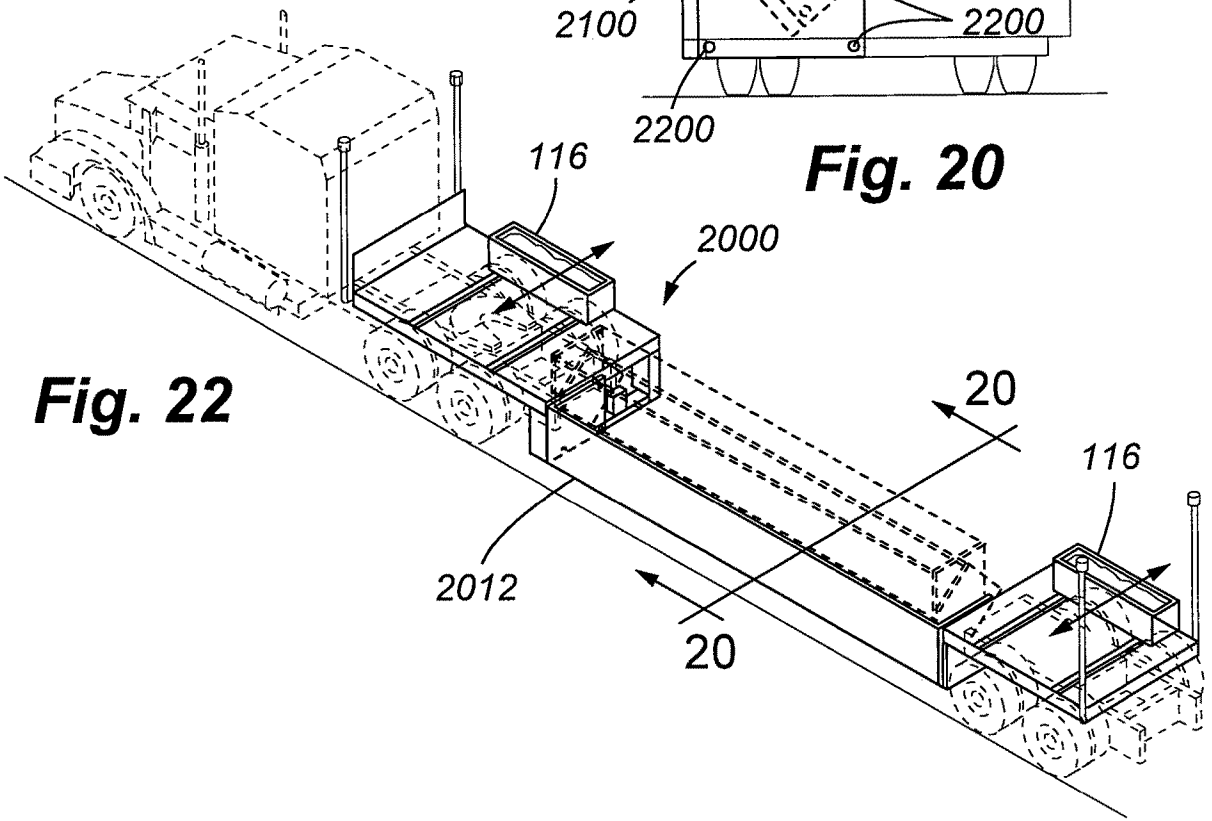
FIG. 22 is an isometric view of the safety trailer.

With reference to FIGS. 20-22, a safety trailer 2000 according to an embodiment includes first and second platforms 2004 and 2008 with a safety wall 2012 rotatably engaged with, and positioned between, the platforms. The safety wall 2012 is, in cross-section, rectangularly shaped due to multiple vertical and horizontal tiers of supporting structural members (not shown), such as the structural design of FIG. 41 or 44. A planar face 2100 of the safety wall 2012 faces vehicular traffic. The safety wall rotates upwards for undeployment/transit and downwards for deployment. The holes 2200 at each end of the safety wall 2012 are at the interface of the safety wall and adjacent platform and therefore pass through both the end of safety wall and the adjacent face of the platform. The holes, when aligned, receive removable dowels. More specifically, when (in FIG. 21) the safety wall 2012 is undeployed for transit, only the aligned set of holes at the top of the adjacent platform receive a dowel to secure the safety wall for transit. When (in FIG. 20) the safety wall 2012 is deployed, all four sets of aligned holes receive a dowel to secure structurally the safety wall to the adjacent platform against vehicular impact. To rotate the safety wall 2012 upwards or downwards, only the set of holes at the point 2110 of rotation receives a dowel; the other sets of holes do not. As will be appreciated, the number of sets of holes can be more or less and depends on numerous factors, primarily the strength specifications and requirements for the interface.

Figure 75:
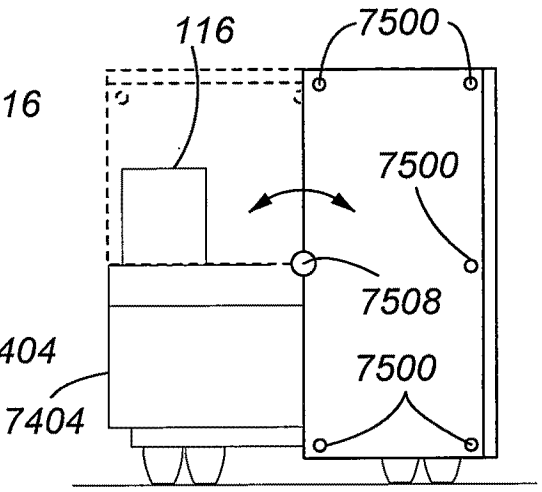
FIG. 75 is a side view of an interlocking mechanism between adjoining platforms according to an embodiment.
Figure 74:
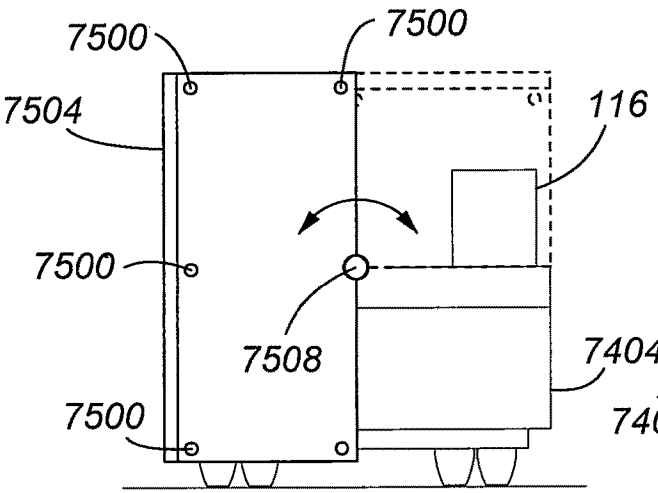
FIG. 74 is a side view of an interlocking mechanism between a safety wall and adjoining platform according to an embodiment.
Figure 76:
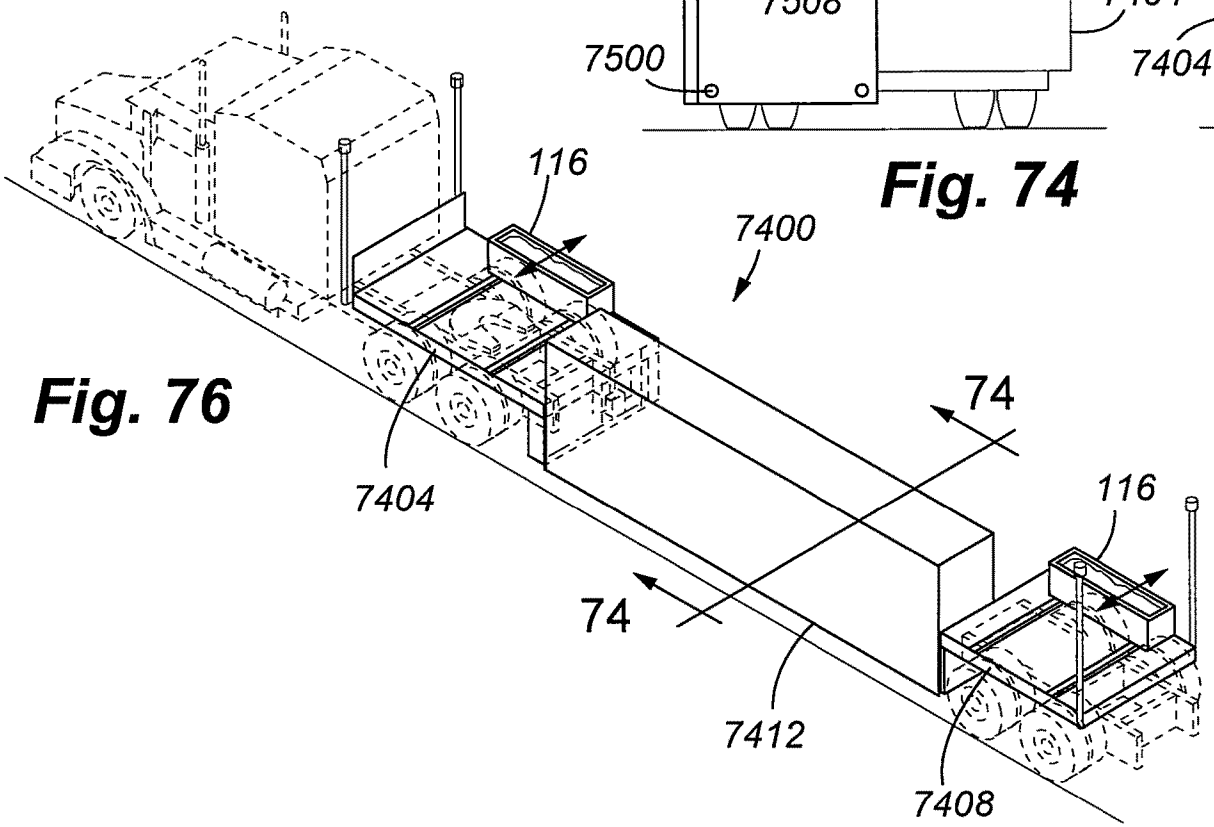
FIG. 76 is a side view of an interlocking mechanism between interconnecting safety wall segments according to an embodiment.

With reference to FIGS. 74-76, a safety trailer 7400 according to an embodiment includes first and second platforms 7404 and 7408 with a safety wall 7412 rotatably engaged with, and positioned between, the platforms. The safety wall 2312 is, in cross-section and like safety wall 2012, rectangularly shaped due to multiple vertical and horizontal tiers of supporting structural members (not shown). The width of the safety wall is substantially the same as the width of the trailer bed and the safety wall is able to rotate, about pivot 7508 (one of which is positioned on each platform), to either side of the safety trailer. In this configuration, the outer skin 7504 of the safety wall faces upwards when not deployed. When the safety wall is deployed to the selected side of the trailer, dowels are placed in the holes 7500 (which align with matching holes in the platform) to impart structural rigidity to the safety wall.

Figure 24:
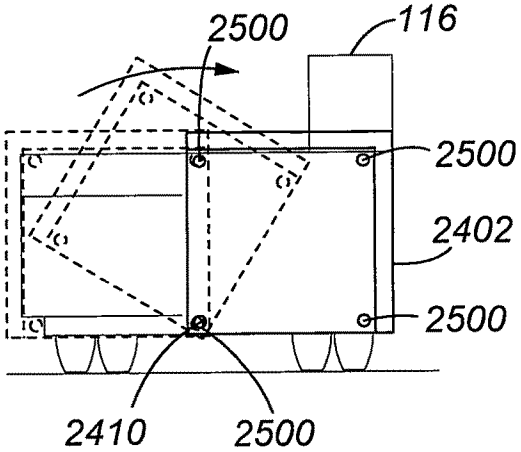
FIG. 24 is a cross sectional view of a deployed safety trailer taken along line 23-23 of FIG. 25 according to an embodiment with the wall structure being moved to a second side of the trailer.
Figure 23:
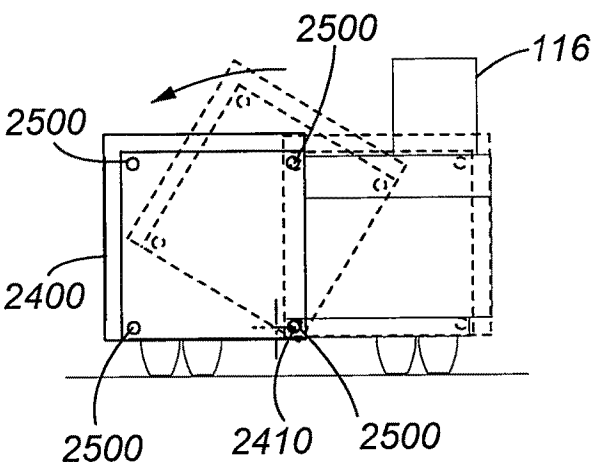
FIG. 23 is a cross sectional view of a deployed safety trailer taken along line 23-23 of FIG. 25 according to an embodiment with the wall structure being moved to a first side of the trailer.
Figure 25:
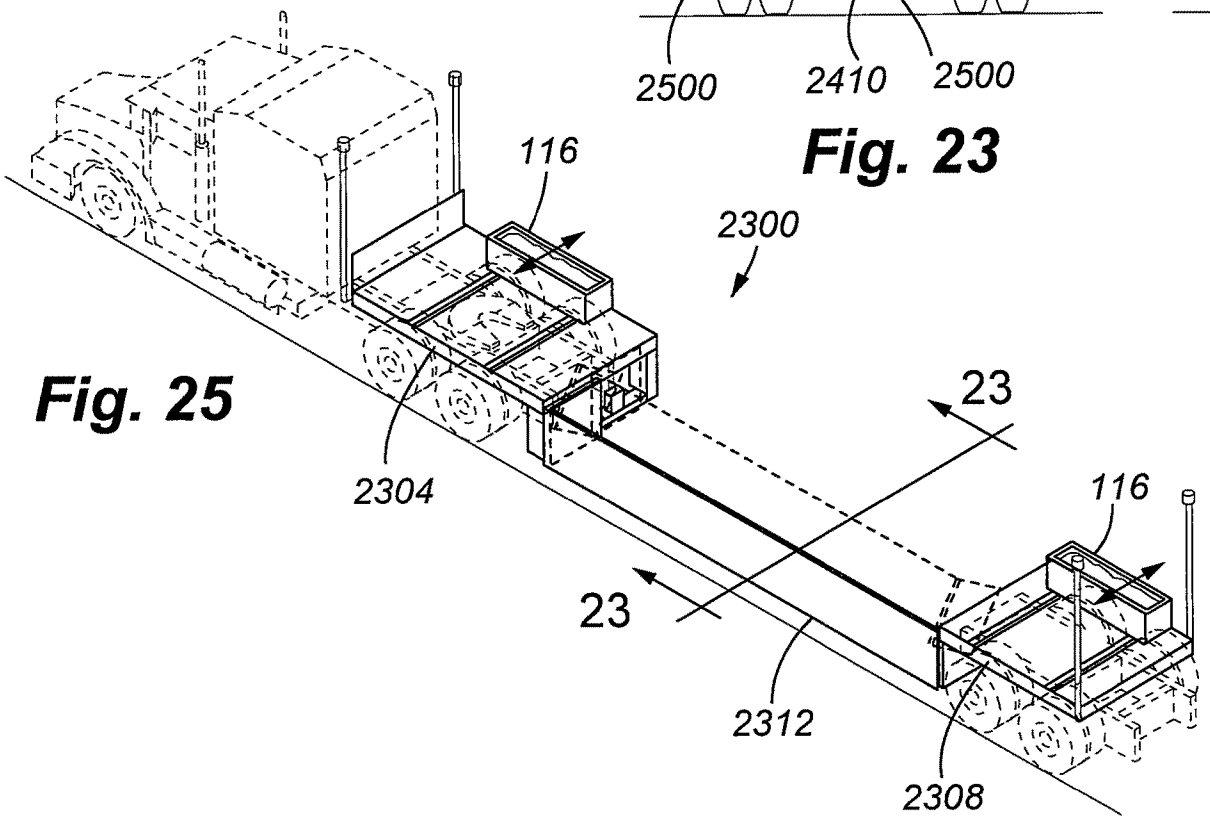
FIG. 25 is an isometric view of the safety trailer.

With reference to FIGS. 23-25, a safety trailer 2300 according to an embodiment includes first and second platforms 2304 and 2308 with a safety wall 2312 rotatably engaged with, and positioned between, the platforms. The safety wall 2312 is, in cross-section and like safety wall 2012, rectangularly shaped due to multiple vertical and horizontal tiers of supporting structural members (not shown). Discrete or separate planar faces 2400 and 2402 of the safety wall 2312 face vehicular traffic depending on the side of the trailer 2300 on which the wall 2312 is deployed. The safety wall rotates to both sides of the trailer 2300 for deployment, depending on the orientation of the trailer 2300 relative to vehicular traffic. When traffic, for instance, is on the right side (facing forwards) of the trailer 2300, the safety wall 2312 is deployed in the position shown in FIGS. 23 and 25. When traffic is on the left side (facing forwards) of the trailer 2300, the safety wall is deployed in the position shown in FIG. 24. The holes 2500 at each end of the safety wall 2312 are at the interface of the safety wall and adjacent platform and therefore pass through both the end of safety wall and the adjacent face of the platform. The holes, when aligned, receive removable dowels. When the safety wall 2312 is deployed, all four sets of aligned holes receive a dowel to secure structurally the safety wall to the adjacent platform against vehicular impact. To rotate the safety wall 2312 to the left or right, only the set of holes at the point 2410 of rotation receives a dowel; the other sets of holes do not. As will be appreciated, the number of sets of holes can be more or less and depends on numerous factors, primarily the strength specifications and requirements for the interface.

Figure 35:
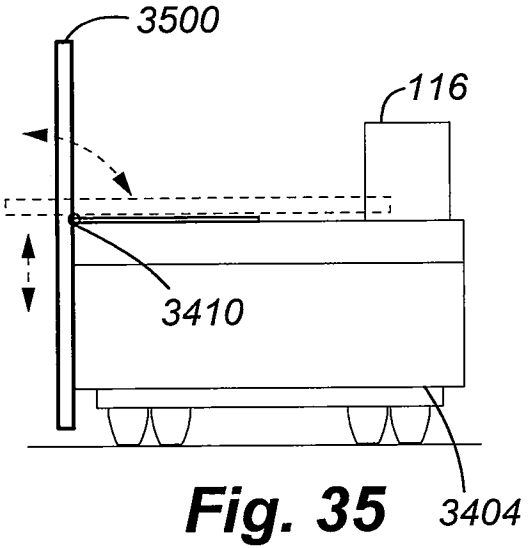
FIG. 35 is a cross sectional view of the safety trailer of FIG. 34 with a deployed safety wall.
Figure 34:
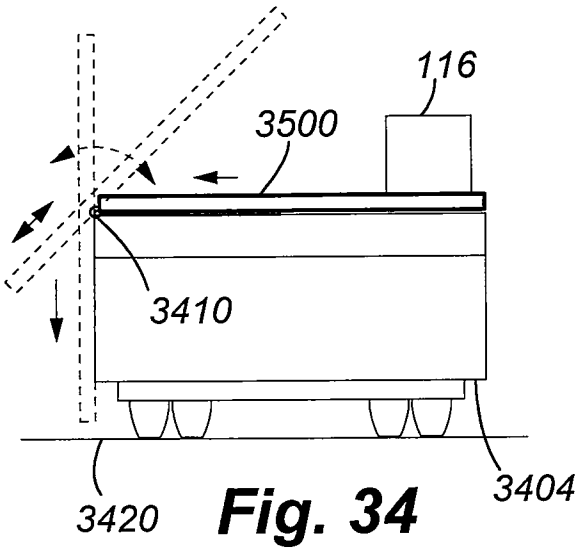
FIG. 34 is a cross sectional view of a safety trailer, with an undeployed safety wall, taken along line 34-34 of FIG. 36 according to an embodiment.
Figure 36:
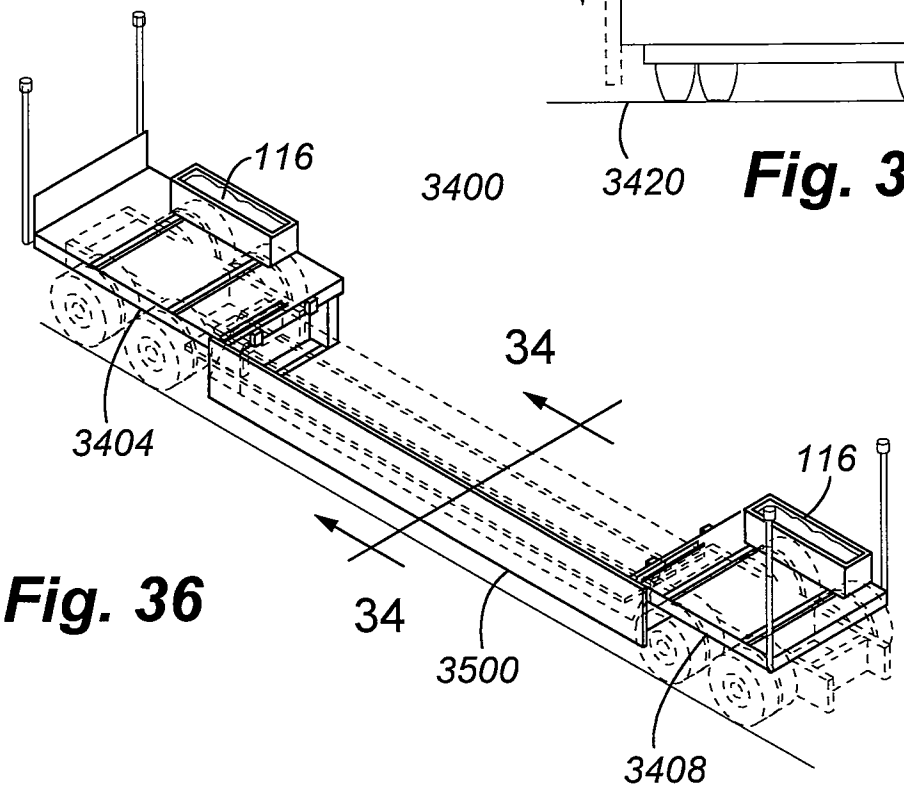
FIG. 36 is an isometric view of the safety trailer of FIG. 34 with a deployed safety wall.
Figure 38:
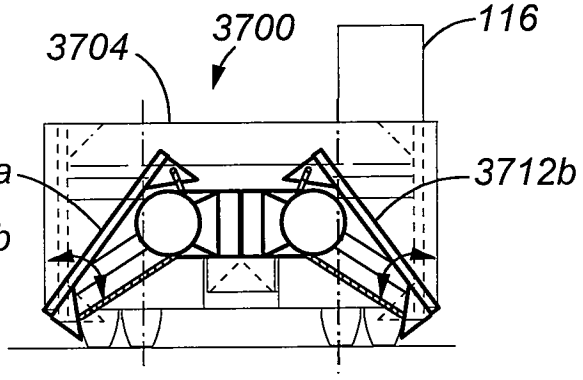
FIG. 38 is a cross sectional view of a safety trailer, with an undeployed safety wall, taken along line 37-37 of FIG. 38.
Figure 37:
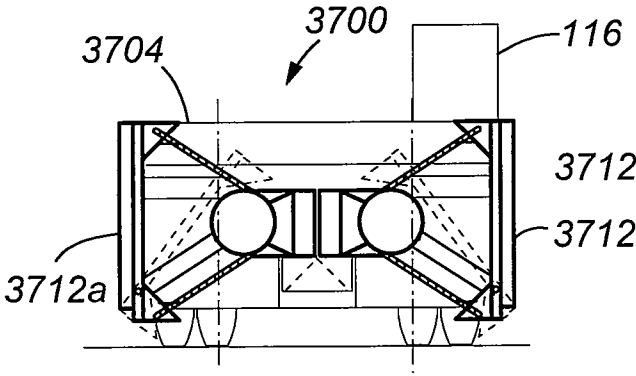
FIG. 37 is a cross sectional view of a safety trailer, with a deployed safety wall, taken along line 37-37 of FIG. 39 according to an embodiment.
Figure 40:
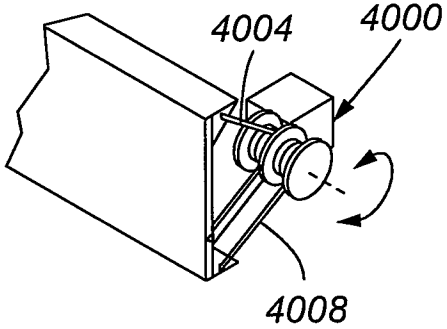
FIG. 40 is a perspective view of the cable mechanism of the safety wall of FIG. 37.
Figure 39:
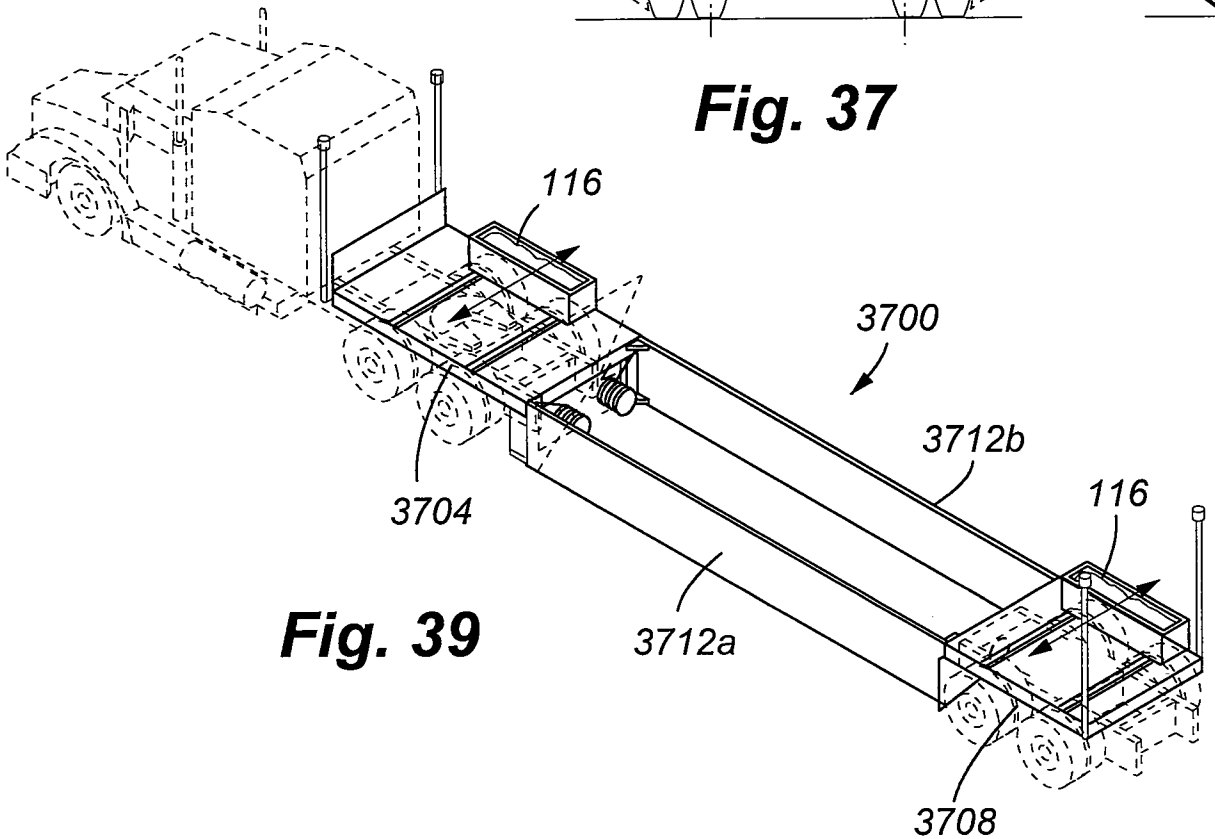
FIG. 39 is an isometric view of the safety trailer of FIG. 37.

FIGS. 34-36 depict yet another safety trailer embodiment. The safety trailer 3400 includes first and second platforms 3404 and 3408 with a safety wall 3500 rotatably positioned therebetween. The safety wall 3500 rotates upwardly for deployment (FIG. 35) and downwardly for undeployment/transit (FIG. 34). The axis of rotation 3600 of the safety wall 3500 is substantially parallel to, but spatially offset from (not in a vertical plane with), a longitudinal axis 3604 of the safety trailer 3400. To position the safety wall 3500 properly, the wall, before, during, or after rotation, also translates along its length and drops downward (for deployment) or moves upward (for nondeployment/transit). Translation may be effected in any manner known to one of ordinary skill in the art. An example would be to position the hinges 3410, about which the safety wall 3500 rotates, in a channel (not shown) on the reverse side of the safety wall 3500. The channel has a specified length to position, at the end of translation, the hinges 3410 and therefore the safety wall 3500 are at a desired height above the road surface 3420.

Figure 64:
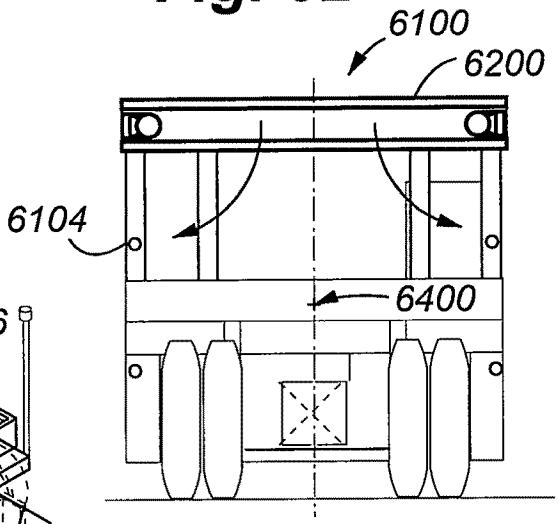
FIG. 64 is a cross sectional view of an undeployed safety trailer of FIG. 61.
Figure 63:
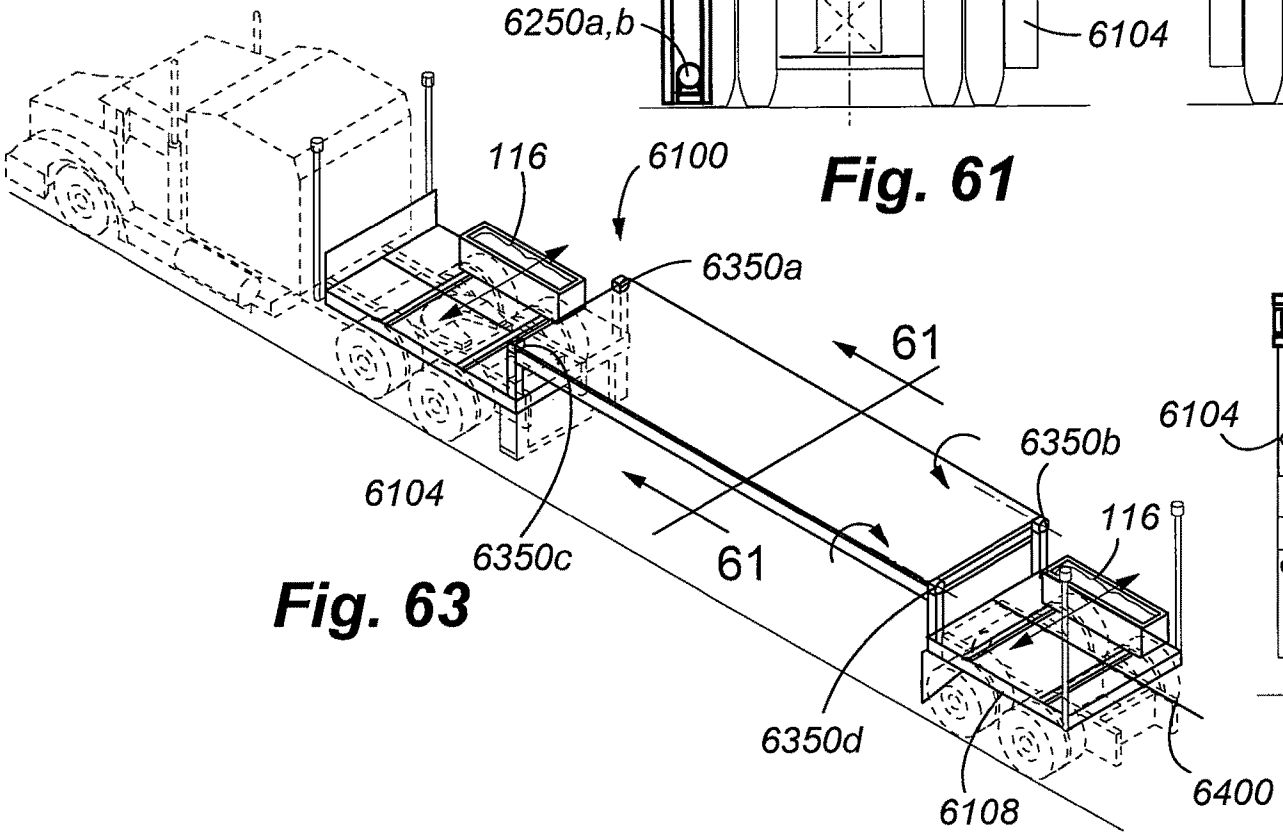
FIG. 63 is an isometric view of the safety trailer of FIG. 61.

FIGS. 61-64 depict yet another safety trailer embodiment. The safety trailer 6100 includes first and second platforms 6104 and 6108 with a safety wall 6200 rotatably positioned therebetween. The safety wall 6200 rotates downwardly for deployment (FIGS. 61-62) and upwardly for undeployment/transit (FIG. 64). The axes of rotation 6300 and 6304 of the safety wall 6200 are substantially parallel to, but spatially offset from (not in a vertical plane with), a longitudinal axis 6400 of the safety trailer 6100. In operation, the safety wall 6200 may be selectively positioned, by selecting an axis of rotation 6300 and 6304, on either side of the safety trailer 6100. By way of example, to position the safety wall 6200 on the left side (FIG. 61) of the safety trailer 6100, the axis of rotation 6300 is disengaged (such as by removing first and second pins or dowels (not shown) from first and second holes 6250*a,b* and/or matching holes in the first and second platforms at first and second interfaces 6350*a,b* between the first and second platforms and the safety wall 6200. After disengagement, the safety wall 6200 is rotated about rotational axis 6304 into the deployed position on the left side of the safety trailer 6100. To position the safety wall 6200 on the right side (FIG. 62) of the safety trailer 6100, the axis of rotation 6304 is disengaged (such as by removing third and fourth pins or dowels (not shown) from first and second holes 6250*c,d* and/or matching holes in the first and second platforms at first and second interfaces 6350*c,d* between the first and second platforms and the safety wall 6200. After disengagement, the safety wall 6200 is rotated about rotational axis 6300 into the deployed position. To place the safety wall 6200 in the undeployed/transit position, the first, second, third, and fourth sets of holes at the interfaces 6350*a-d* and/or matching holes in the first and second platforms are aligned (by rotating the safety wall as needed) and dowels or pins inserted (if absent) into the aligned set of holes at each interface. When deployed on either side of the trailer, holes 6400 on either end of the wall 6200 align with matching holes in the adjacent platform. Dowels or pins are inserted into the holes to provide structural strength to the interfaces between the platforms and walls.

Figure 53:
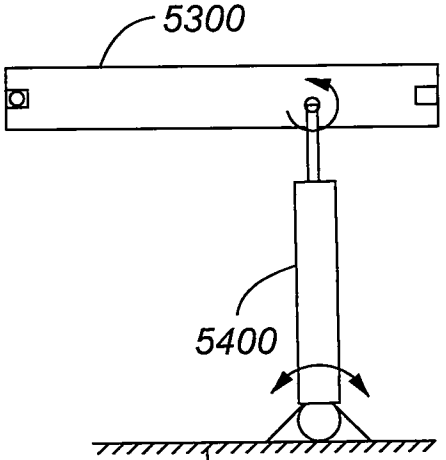
FIG. 53 is an undeployed safety wall according to an embodiment.
Figure 54:
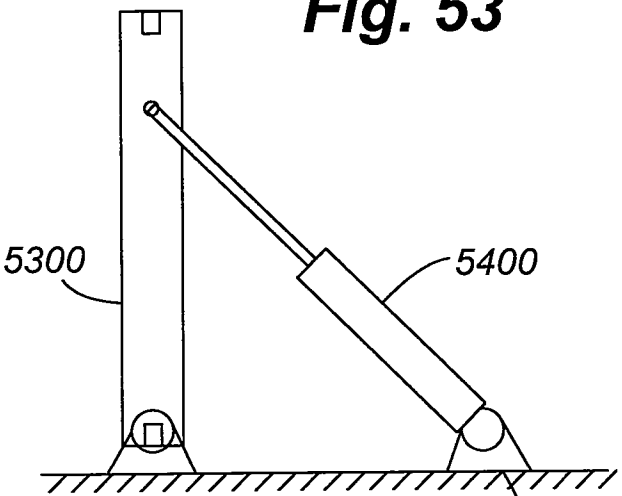
FIG. 54 is a deployed safety wall according to an embodiment.

In any of the foregoing embodiments, the safety wall may be lifted or retracted by one or more hydraulic cylinders. Referring to FIGS. 53-54, a safety wall 5300 rotatably engages a hydraulic cylinder 5400, which in turn rotatably engages a platform 5404. When the safety wall 5300 is not deployed, the hydraulic cylinder 5400 is retracted, as in FIG. 53. In one configuration, the safety wall 5300 is substantially horizontal. When the safety wall 5300 is deployed, the hydraulic cylinder 5400 is extended, as in FIG. 54. In one configuration, the safety wall 5300 is substantially vertical. This embodiment may be used to make a safety wall deployable on one or both sides of a safety trailer.

Accordion-Like Safety Wall Trailer Designs

In a number of safety trailer embodiments, the safety wall retracts accordion-like and has multiple axes of rotation that are transverse (typically substantially orthogonal) to a longitudinal axis of the trailer.

Figure 26:
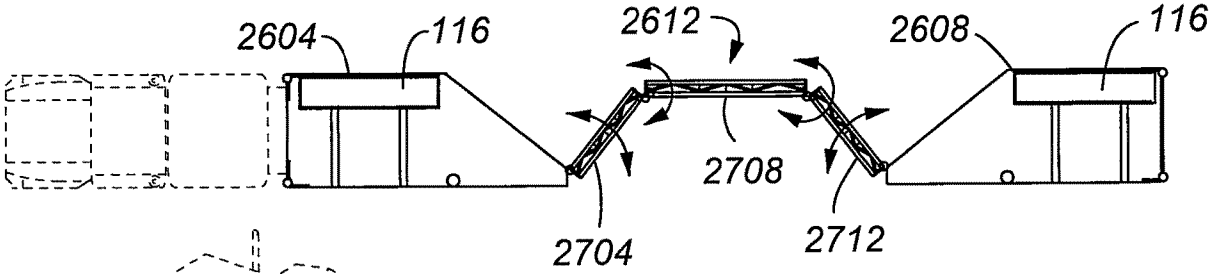
FIG. 26 is a plan view of a partially deployed safety wall according to an embodiment.
Figure 27:
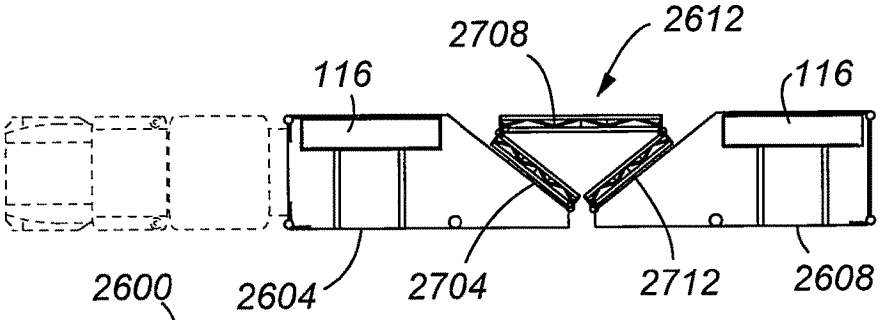
FIG. 27 is a plan view of an undeployed safety wall according to the embodiment of FIG. 26.
Figure 28:
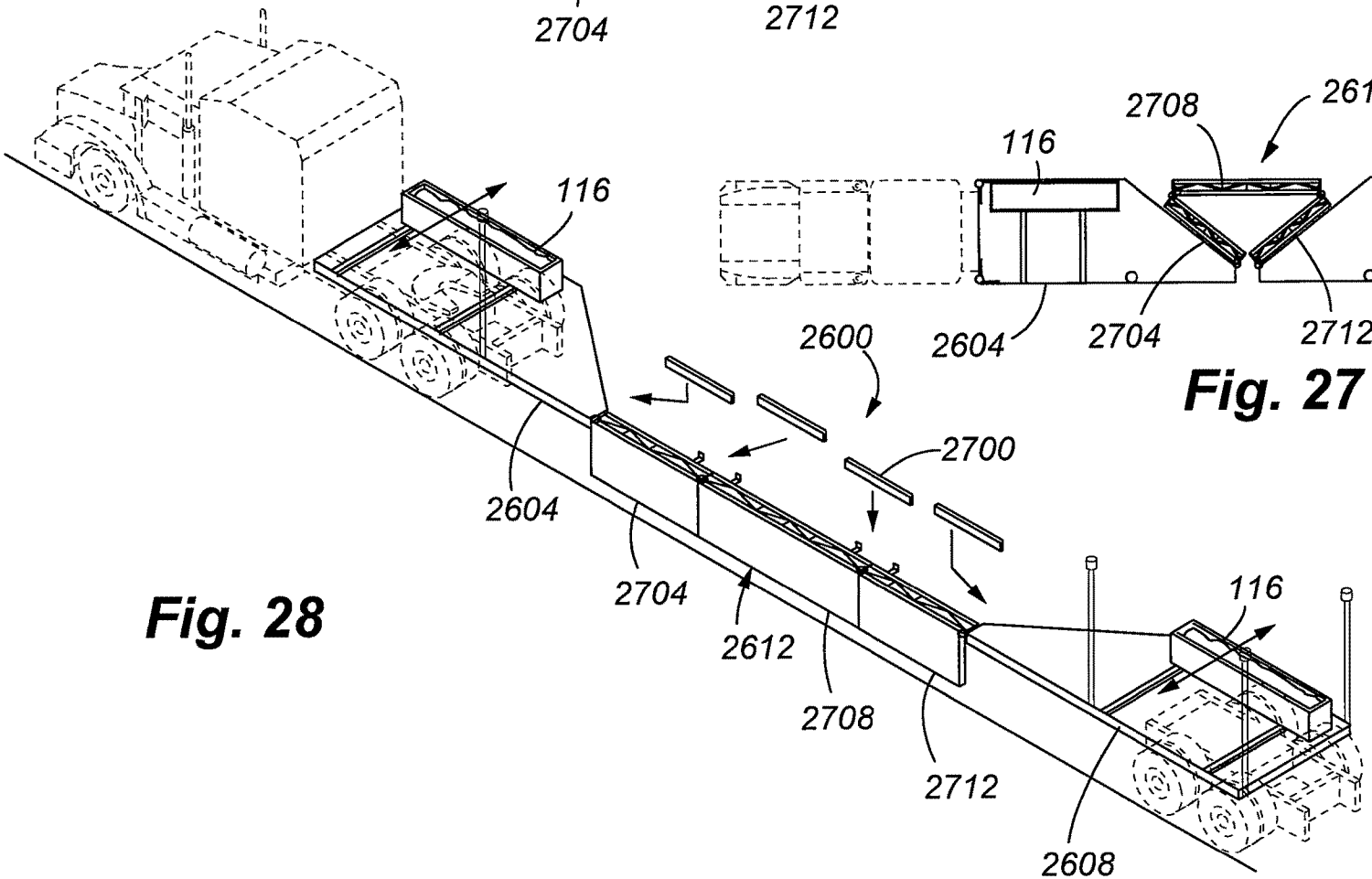
FIG. 28 is an isometric view of the deployed safety wall according to the embodiment of FIG. 26.

Referring to FIGS. 26-28, a safety trailer 2600 according to an embodiment of this design includes first and second platforms 2604 and 2608 and an accordion-like safety wall 2612 positioned between, and engaged with, the first and second platforms 2604 and 2608. The safety wall 2612 includes a plurality of rotatably connected wall segments 2704, 2708, and 2712, each being rotatable, about a vertical axis, with respect to an adjacent wall segment or, as appropriate, an adjacent first or second platform. At each such interface, a hinge-like interconnection is typically employed. When the safety wall 1612 is deployed as in FIG. 28, one or more support members 2700 is used to brace the rotatable interconnection between adjacent wall segments or wall segment and adjacent platform to inhibit rotation of the wall segment in the event of vehicular impact. Brackets 2704 are positioned on either side of the rotatable interconnection to receive the support members 2700.

Figure 29:
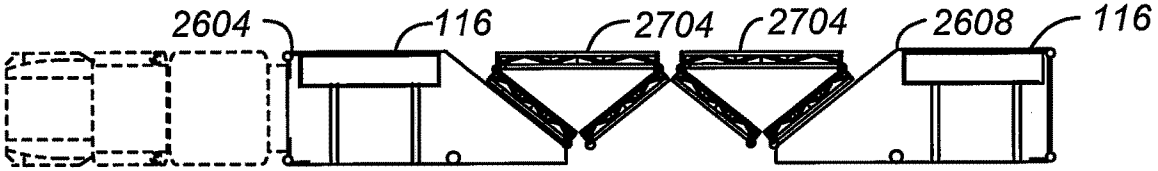
FIG. 29 is a plan view of an undeployed safety wall according to an embodiment.
Figure 30:
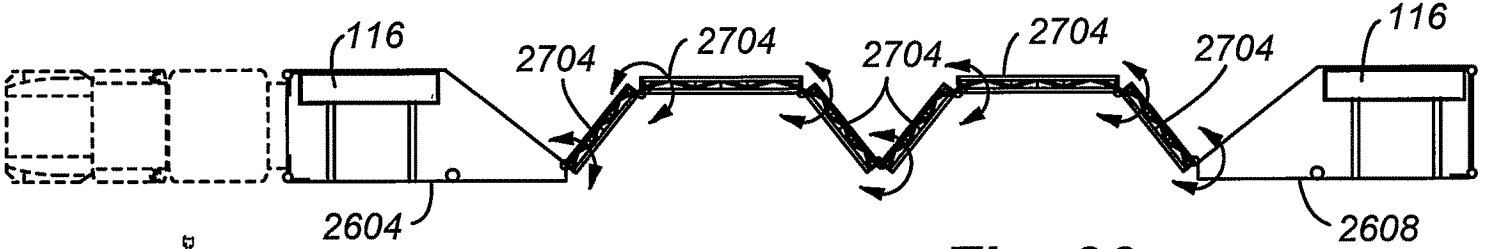
FIG. 30 is a plan view of a partially deployed safety wall according to the embodiment of FIG. 29.
Figure 31:
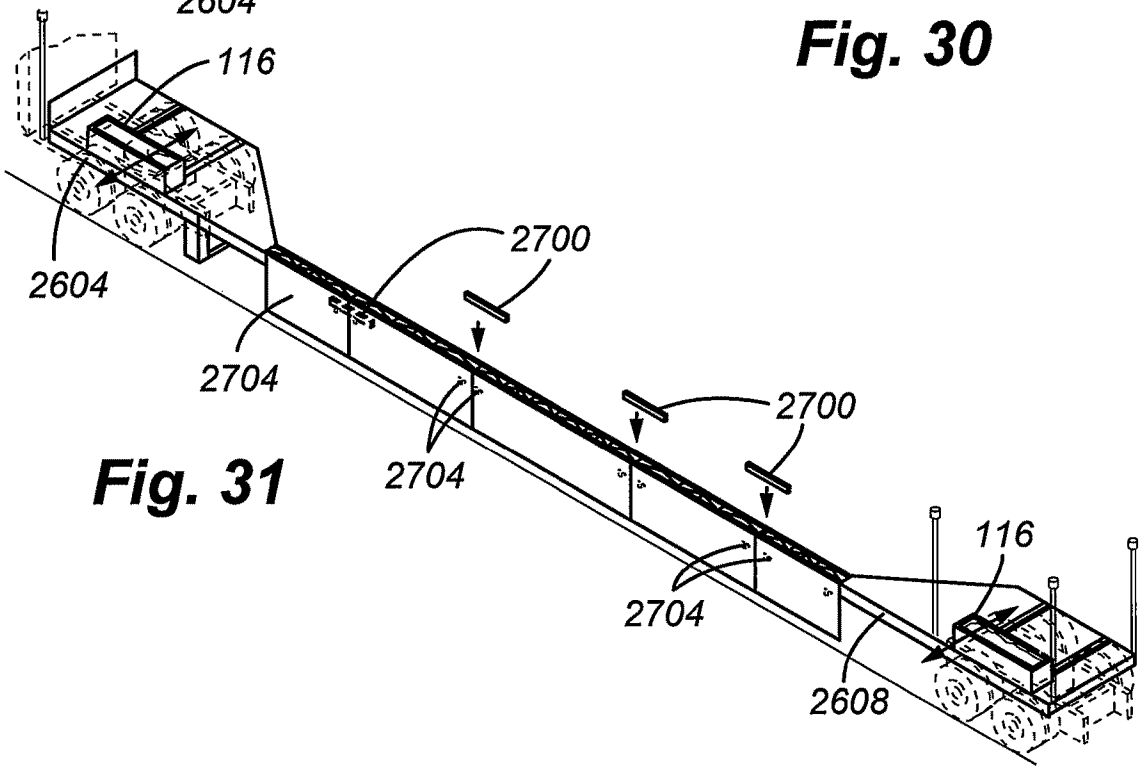
FIG. 31 is an isometric view of the deployed safety wall according to the embodiment of FIG. 29.

Referring to FIGS. 29-31, a safety trailer 2900 according to another embodiment includes first and second platforms 2604 and 2608 and an accordion-like safety wall 2912 positioned between, and engaged with, the first and second platforms 2604 and 2608. The safety trailer 2900 is similar to the safety trailer 2600 except that it contains more interconnected wall segments 2704. As will be appreciated, the number of interconnected wall segments 2704 is a function of the desired length of the safety wall (and size of the protected work area). Thus relative to FIGS. 26-31, more or fewer wall segments may be employed.

Adjustable Inclination Safety Wall Designs

In a number of safety trailer embodiments, an orientation/inclination of the safety wall is adjustable to deploy or undeploy the safety wall.

FIGS. 37-40 depict a safety trailer according to an embodiment of this design. The safety trailer 3700 includes first and second platforms 3704 and 3708 and first and second safety walls 3712*a,b* positioned between, and engaged with, the first and second platforms 3704 and 3708. The inclinations of the safety walls 3712*a,b* are vertical when deployed (as in FIG. 37) and nonvertical (or inclined relative to vertical) when undeployed (as in FIG. 38). The inclination is adjusted by one or more arms 3800 (about which the respective wall rotates) and a double spooled cable reel 4000. The reel 4000 includes first and second cables 4004 and 4008 each spooled around a separate spool. When the reel 4000 is rotated clockwise, cable 4004 is tightened, or collected on the corresponding spool while cable 4008 is loosened, or spooled out on the corresponding spool, and when the reel 400 is rotated counterclockwise, cable 4008 is tightened, or collected on the corresponding spool while cable 4004 is loosened, or spooled out on the corresponding spool. As cable 4004 is collected and cable 4008 spooled out, the safety wall 3712 rotates in the clockwise direction, and as cable 4008 is collected and cable 4004 spooled out, the safety wall 3712 rotates in the counterclockwise direction. In this manner, the safety wall 3712 is rotated into and out of the vertical position.

Slide Safety Wall Trailer Designs

In a number of safety trailer embodiments, the safety wall is moved from side-to-side by sliding.

Figure 45:
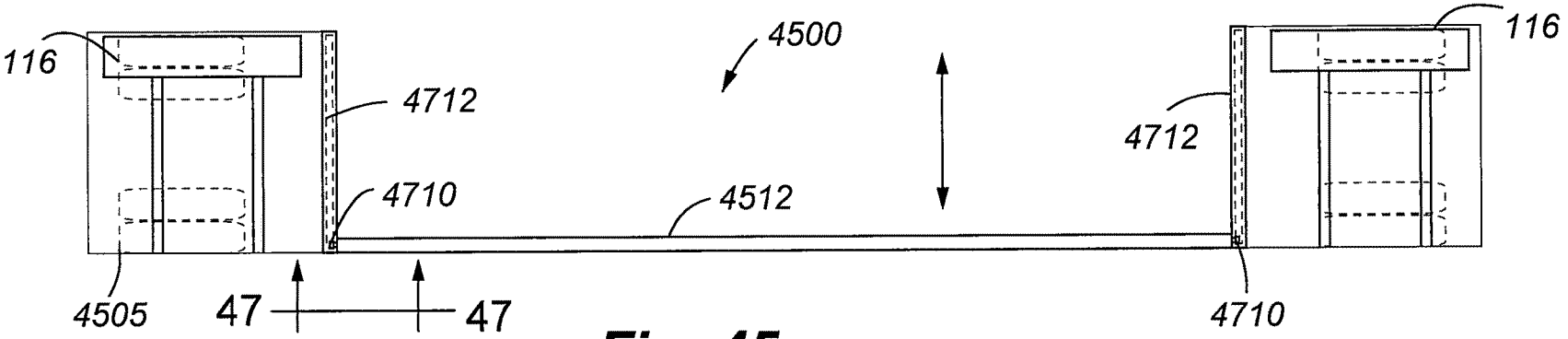
FIG. 45 is a plan view of a safety trailer according to an embodiment.
Figure 47:
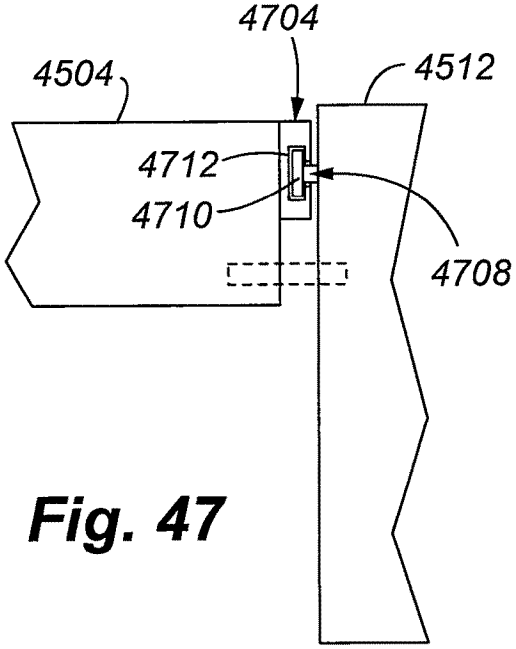
FIG. 47 is a side view of the safety wall attachment mechanism of FIG. 45 according to an embodiment.
Figure 46:
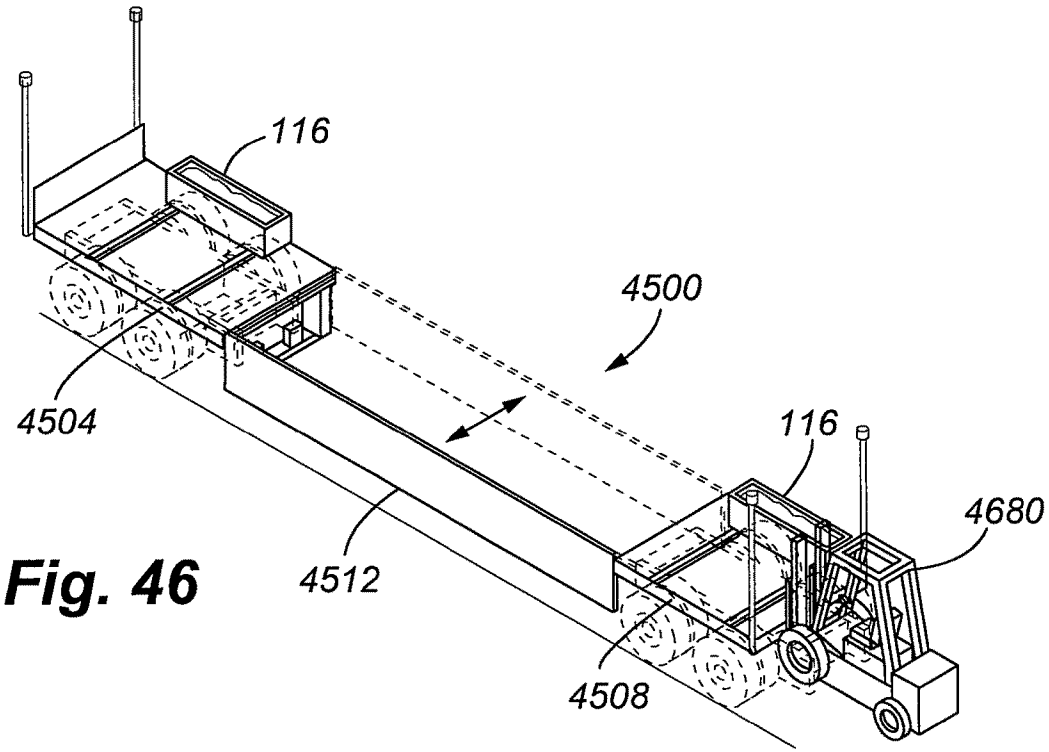
FIG. 46 is an isometric view of the safety trailer of FIG. 45.

FIGS. 45-47 depict a safety trailer according to an embodiment of this design. The safety trailer 4500 includes first and second platforms 4504 and 4508 and safety wall 4512 positioned between, and slidingly engaged with, the first and second platforms 4504 and 4508. The safety wall 4512 is translated linearly back-and-forth between the left and right sides of the safety trailer 4500 depending on the orientation of the safety trailer relative to oncoming traffic. A forklift 4680, or other suitable equipment, mounted on the safety trailer when in transit, is used to push the safety wall 4512 to the desired position. The linear translation mechanism is depicted in FIG. 47. The interface 4700 between the first (and second) platforms 4504 (and 4508) includes a channel member 4704 and roller assembly 4708, which includes a rotatably (relative to the safety wall 4512) roller 4710 that rolls from side-to-side in the channel 4712 of the channel member 4704. When the safety wall 4512 is in the desired position relative to the first and second platforms 4504 and 4508, one or more dowels 4716 are inserted into aligned pairs of holes, one hole being in the safety wall 4512 and the other being in the adjacent platform, to hold the safety wall 4512 in position in the event of a vehicular impact.

Figure 48:
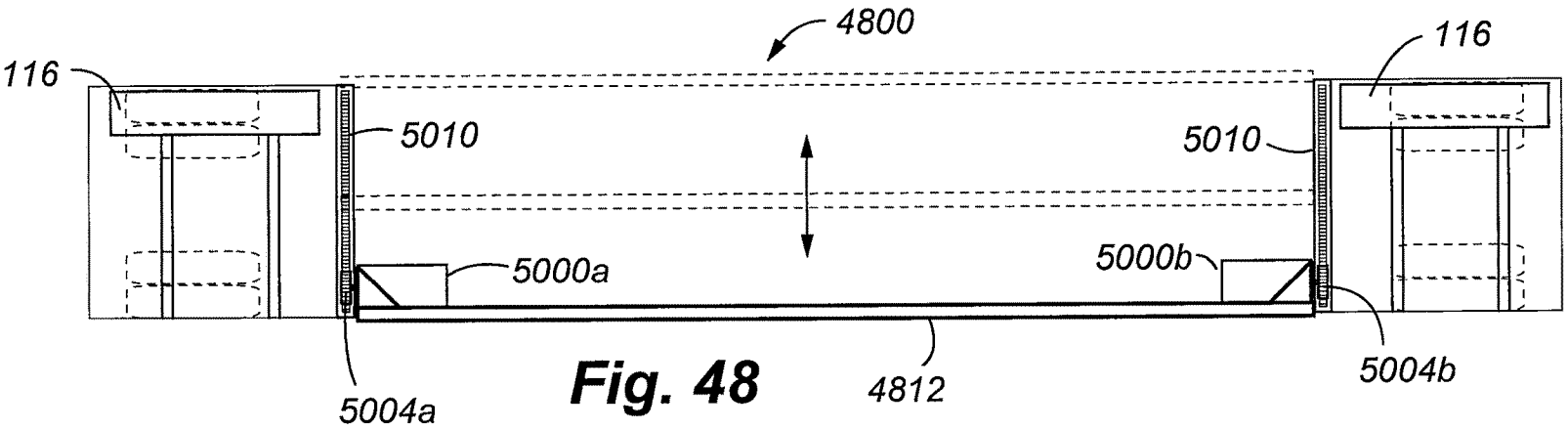
FIG. 48 is a plan view of a safety trailer according to an embodiment.
Figure 50:
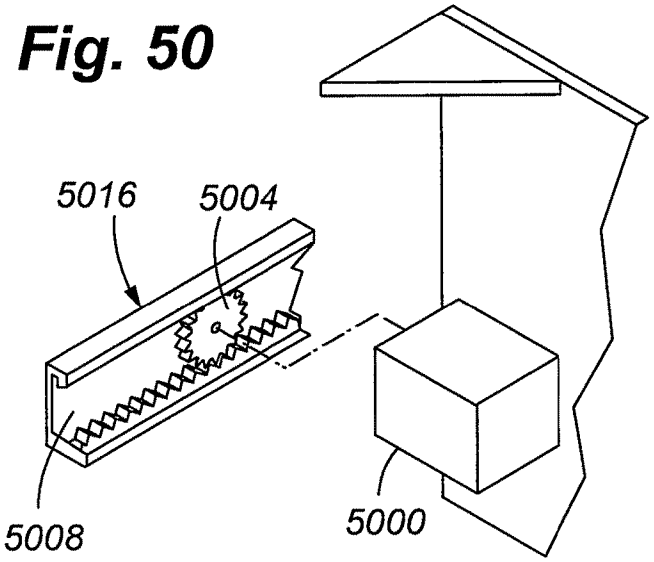
FIG. 50 is a safety wall deployment mechanism for the safety trailer of FIG. 48.
Figure 49:
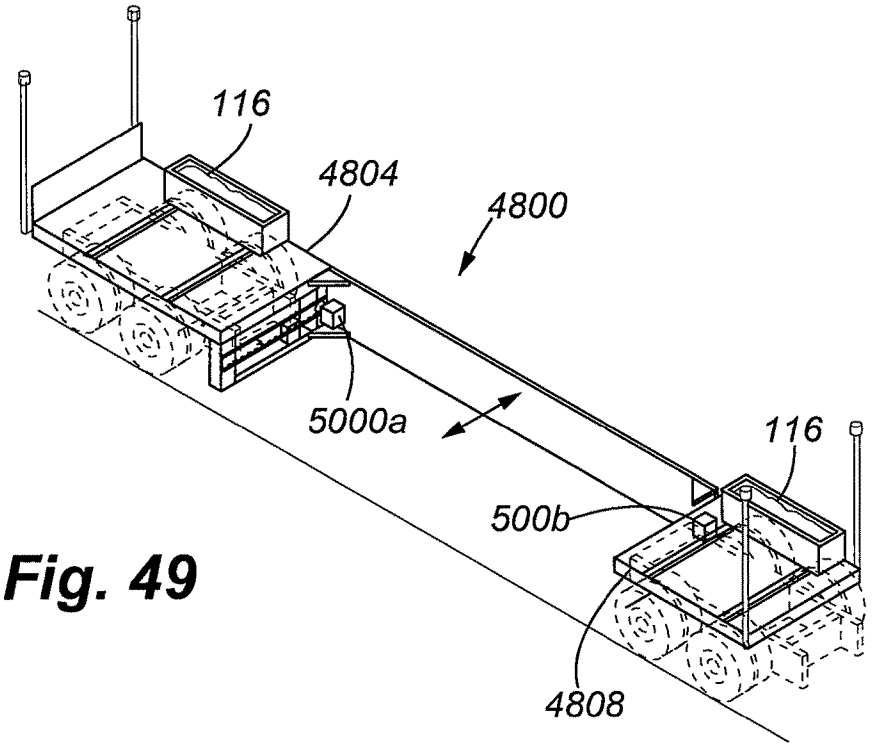
FIG. 49 is an isometric view of the safety trailer of FIG. 48.

FIGS. 48-50 depict a safety trailer according to an embodiment of this design. The safety trailer 4800 includes first and second platforms 4804 and 4808 and safety wall 4812 positioned between, and engaged with, the first and second platforms 4804 and 4808. As in the case of safety wall 4512, the safety wall 4812 is translated linearly back-and-forth between the left and right sides of the safety trailer 4800 depending on the orientation of the safety trailer relative to oncoming traffic. Unlike safety wall 4512, the safety wall 4812 is moved side-to-side by first and second motors 5000*a,b* positioned on either side of the safety wall 4812 (or alternatively positioned inside of the adjacent platform). Each of the motors 5000*a,b* engages a respective gear 5004*a,b* that, in turn, engages a toothed channel 5008 in a channel member 5010 positioned in the adjacent platform. The motors each turn a respective gear to move the safety wall 4812 back-and-forth in the channel 5008. Because positioning the motors 5000*a,b* on the safety wall 4812 effectively renders the safety wall usable on only one side of the trailer 4800 to resist vehicular impact, it is preferred that the gear 5004*a,b* be rotatably engaged with an adjacent end of the safety wall 4812 and rigidly engaged with a shaft (not shown) of the corresponding motor and the motor be positioned inside of the respective first and second platform 4804 and 4812. In this manner, each of the opposing sides of the safety wall, when deployed, presents a substantially planar surface to intercept vehicular traffic incursions.

Lift Off Safety Wall Trailer Designs

In a number of safety trailer embodiments, the safety trailer has an on-board lifting device, such as a crane, to lift a safety wall from a bed of the safety trailer and deploy the safety wall to a selected side of the safety trailer.

Figure 51:
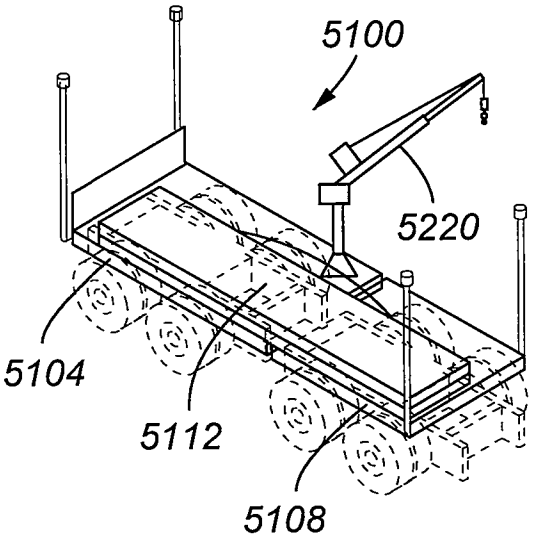
FIG. 51 is a partial isometric view of a safety trailer according to an embodiment.
Figure 52:
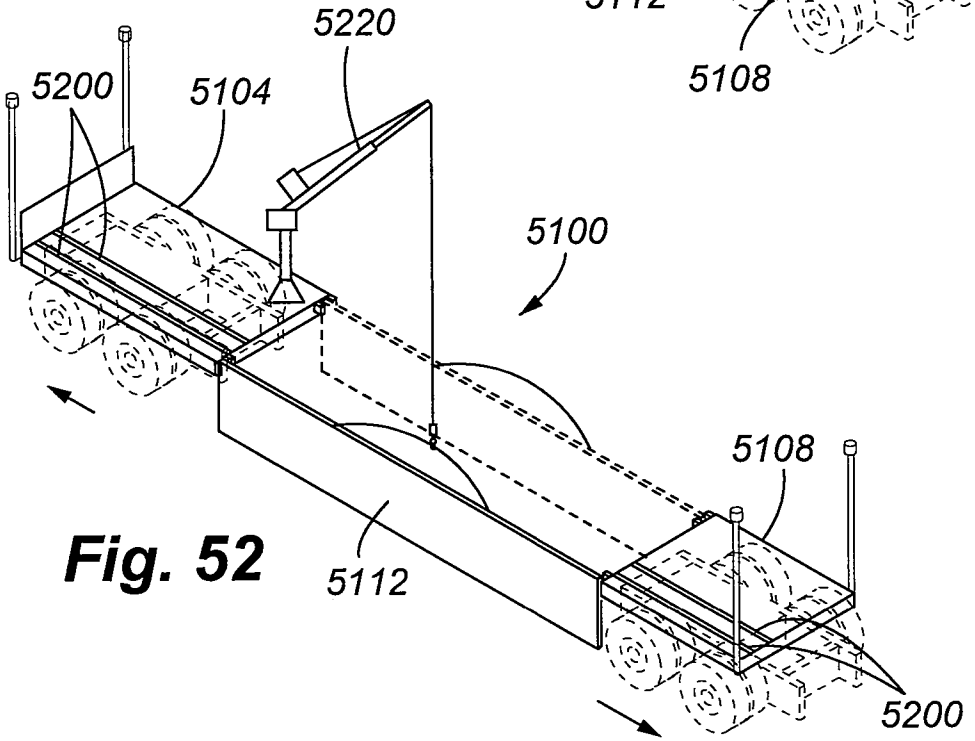
FIG. 52 is a partial isometric view of the safety trailer of FIG. 51.
Figure 71:
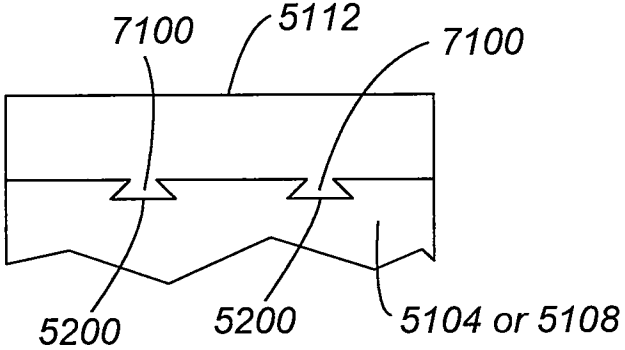
FIG. 71 is a cross sectional view of an interface between a safety wall and a platform according to an embodiment.

FIGS. 51-52 and 71 depict a safety trailer according to an embodiment of this design. The safety trailer 5100 includes first and second platforms 5104 and 5108 and safety wall 5112 positioned between, and engaged with, the first and second platforms 5104 and 5108. The safety trailer 5100 includes a plurality of channels 5200 on each of the first and second platforms 5104 and 5108, which receive identically shaped tongues 7100 on the reverse side of the safety wall 5112. When, as in FIG. 51, the safety wall is not deployed or in transit mode, the plurality of channels 5200 engage the tongues 7100 in the safety wall 5112, preventing removal of the safety wall from the bed defined by the first and second platforms. To deploy the safety wall 5112, the first and second platforms 5104 and 5108 are moved apart, in the direction shown in FIG. 52, to disengage the tongues 7100 from the corresponding channels 5200 by moving the tongues linearly out of the channels. In one configuration, independently operable brakes on the second platform are activated to hold the second platform stationary while the first platform is moved in the direction shown. An on board crane 5220, before or during disengagement of the tongues from the channels, is attached to safety wall, as shown in FIG. 52, such that, when the tongues are removed completely from the channels, the safety wall is suspended, by the crane, above the road surface. The safety wall may then be moved to and engaged with, such as by placing dowels in aligned holes at the interface of the safety wall and adjacent platform, the selected side of the safety trailer. To avoid hang ups with an impacting vehicle, the safety wall is deployed with the planar side facing outwardly and the tongues facing inwardly, relative to the work area.

Figure 57:
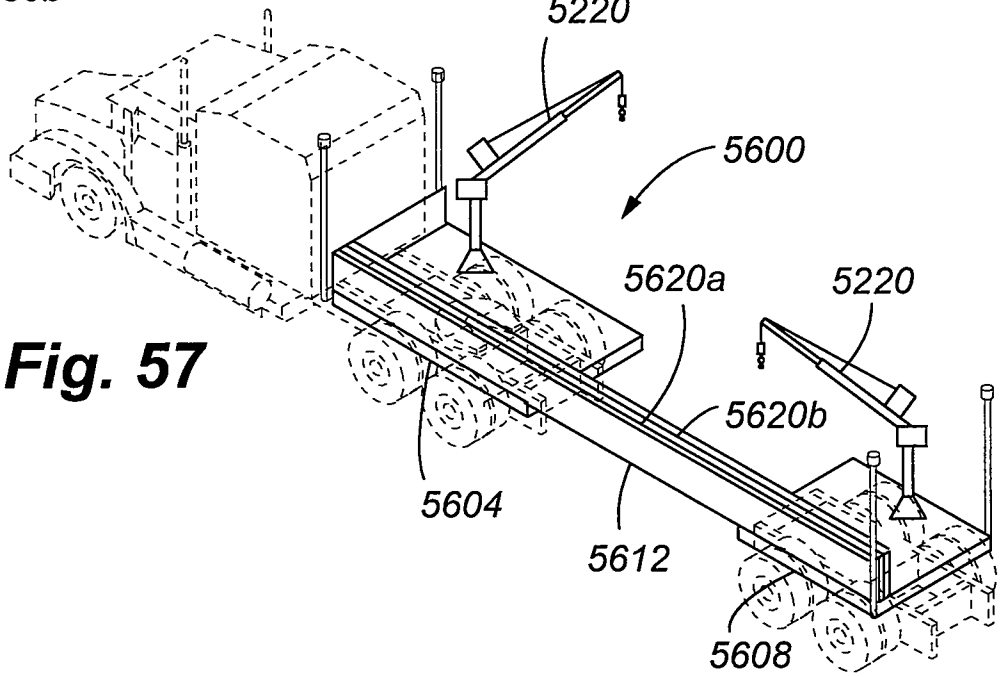
FIG. 57 shows a crane-equipped safety trailer according to an embodiment.
Figure 56:
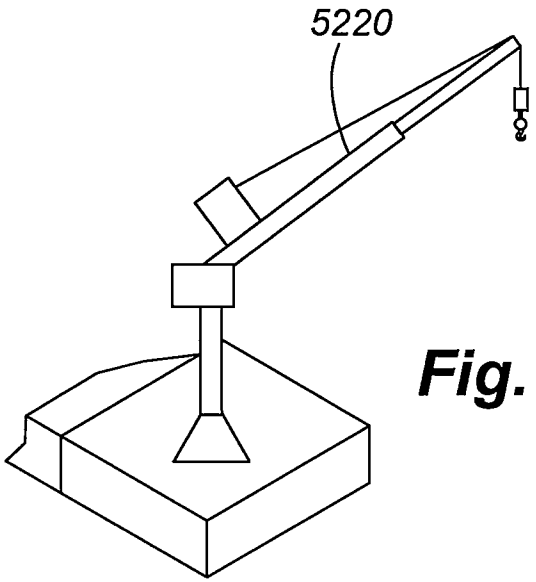
FIG. 56 is a platform-mounted crane according to an embodiment.
Figure 58:
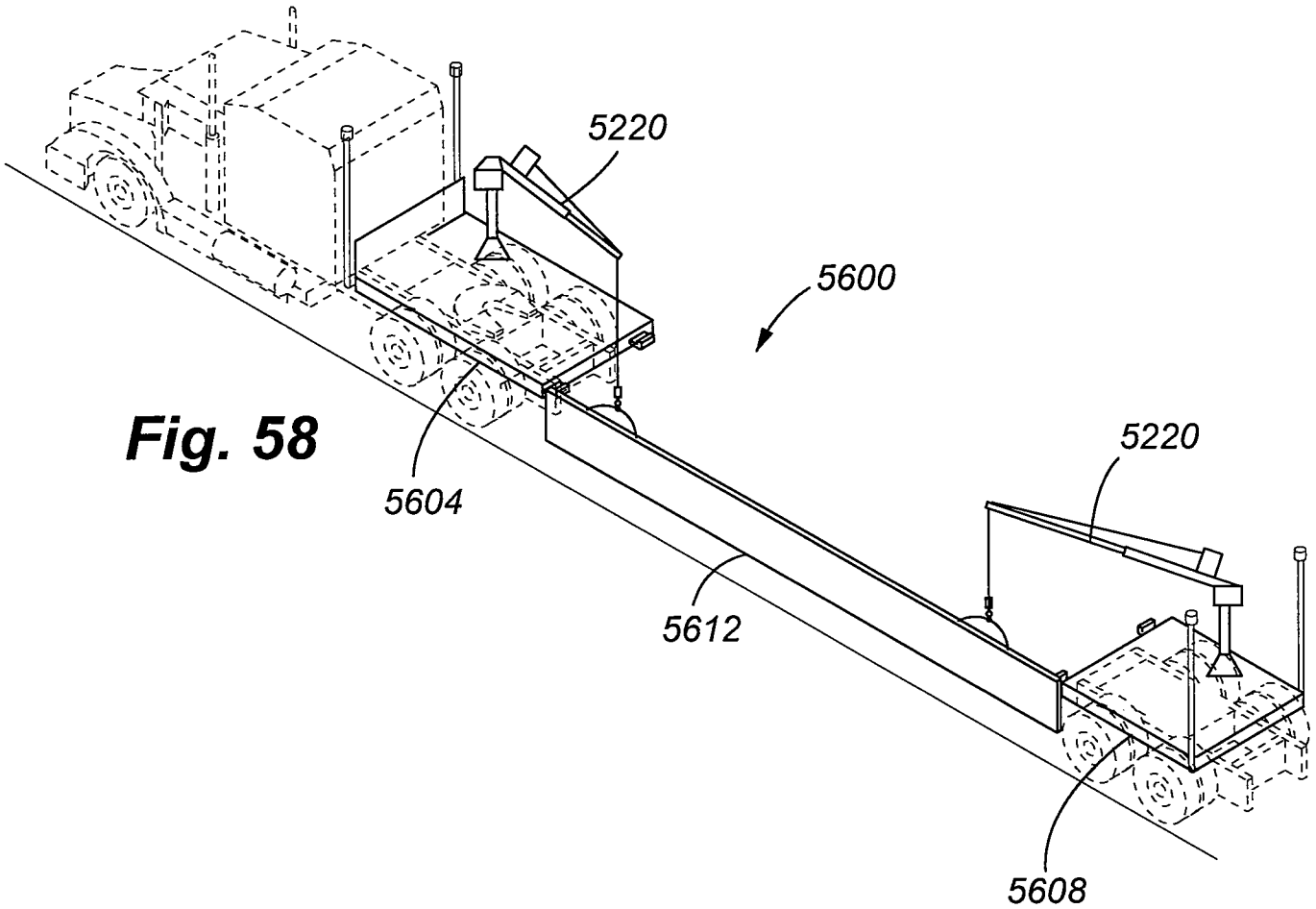
FIG. 58 shows a deployed safety wall according to an embodiment.

FIGS. 56 and 57 depict an embodiment of a safety trailer 5600 in which a crane 5220 is positioned on each of the first and second platforms 5704 and 5708. One or more sections 5620*a,b* of the safety wall 5612 are removed by the cranes, by attaching the respective booms to different attachment points. The safety wall sections 5620*a,b* are positioned, either end-to-end on one side of and between or one on each side of, the first and second platforms 5604 and 5608. FIG. 58 depicts a safety wall 5612 being positioned on one side of the safety trailer 5600.

Figure 69:
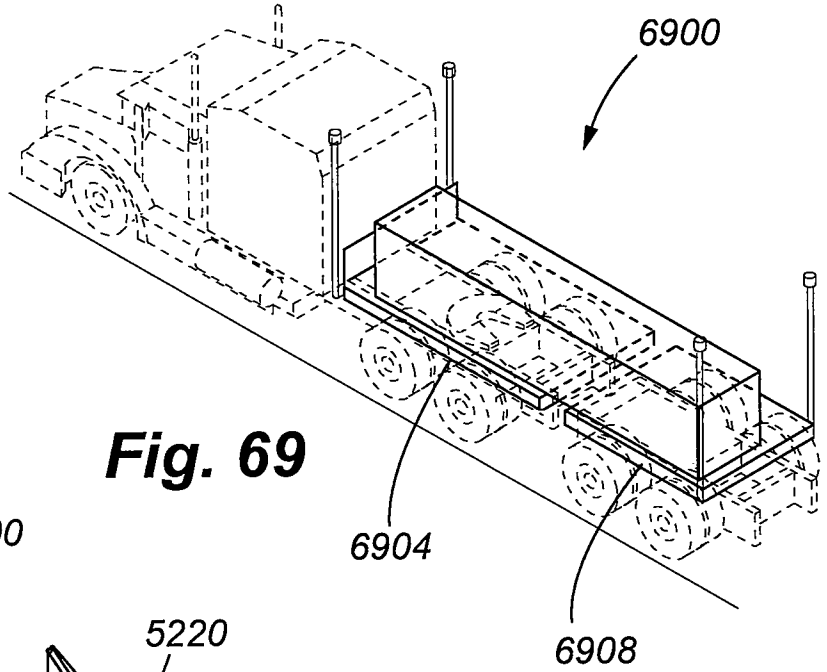
FIG. 69 is an isometric view of an undeployed safety trailer according to an embodiment.
Figure 70:
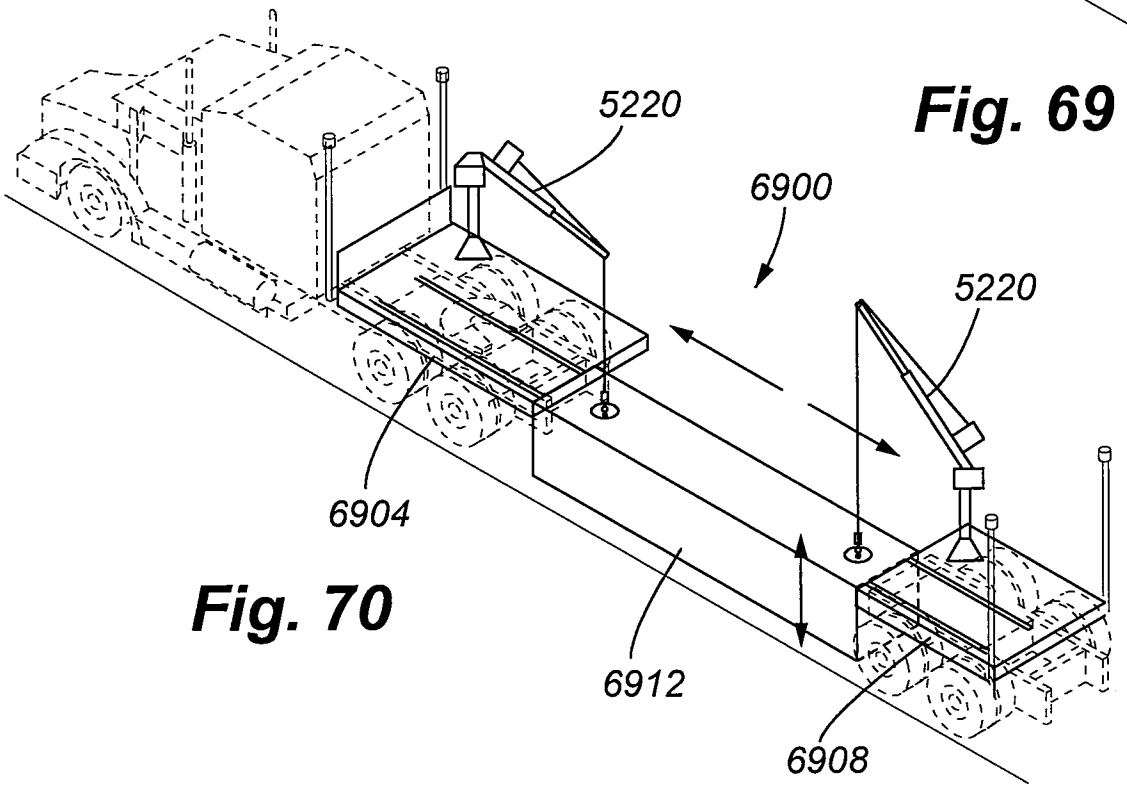
FIG. 70 is an isometric view of a deployed safety trailer of FIG. 69.

FIGS. 69 and 70 depict a safety trailer 6900 according to another embodiment. The safety trailer 6900 includes first and second platforms 6904 and 6908 and safety wall 6912 positioned between, and engaged with, the first and second platforms 6904 and 6908. The safety wall, as in the embodiment of FIGS. 51-52 and 71, includes a plurality of channels 7000 on each of the first and second platforms 6904 and 6908, which receive identically shaped tongues (not shown) on the reverse side of the safety wall 6912. When the first and second platforms 6904 and 6908 are moved apart to release the tongues from the corresponding set of channels, first and second cranes 5220 attach to respective attachment points on the safety wall 6912 and lower the safety wall 6912 into position on the desired side of the safety trailer 6900. Unlike the embodiment of FIGS. 51-52, the attachment points are on the upper edge, and not on the sides, of the safety wall 6912. When the wall is in the desired deployed position, dowels, or some other attachment mechanism, can be used to secure the safety wall 6912 to each of the first and second platforms 6904 and 6908.

Slide Safety Wall Trailer Designs

In a number of safety trailer embodiments, the safety wall is deployed via a sliding mechanism, between the safety wall and safety trailer and/or between different segments of the safety wall.

Figure 59:
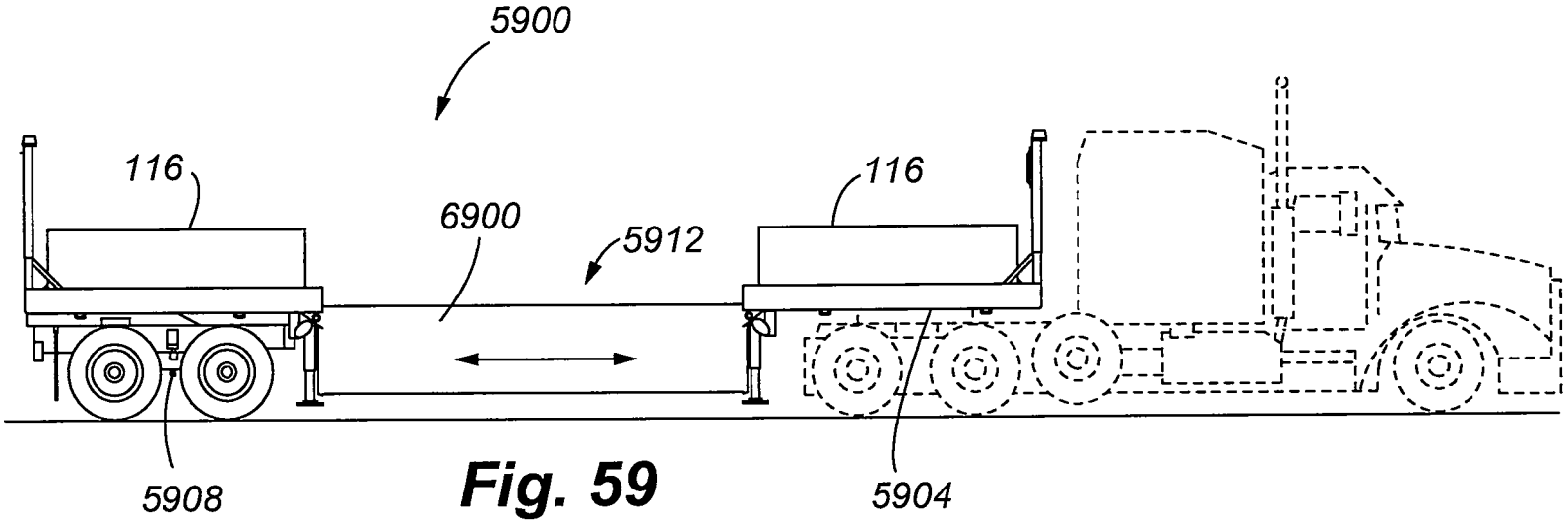
FIG. 59 shows a safety trailer according to an embodiment.
Figure 60:
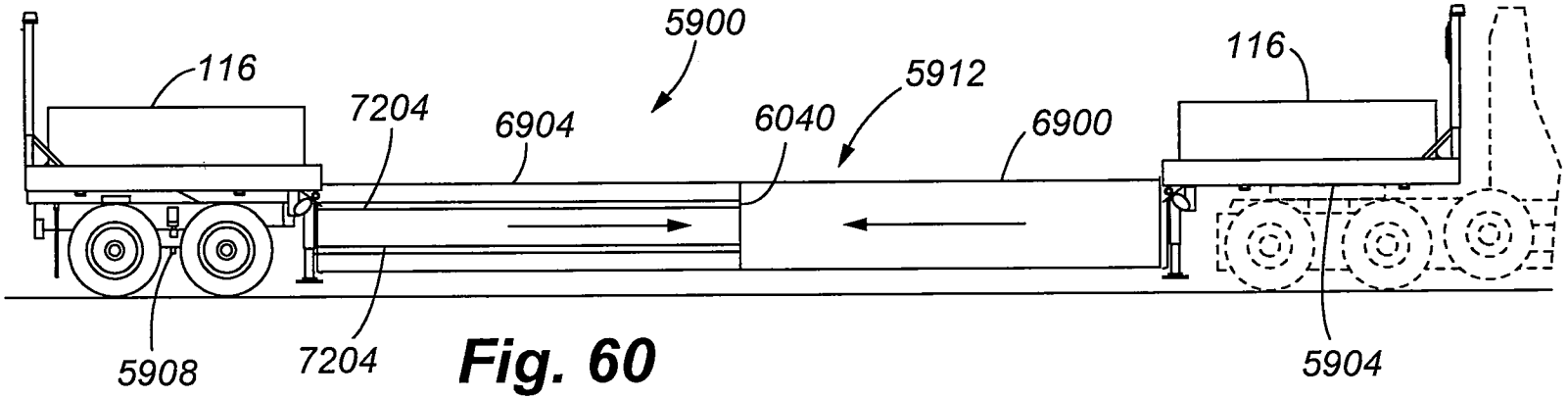
FIG. 60 shows a deployed safety trailer according to an embodiment.
Figure 62:
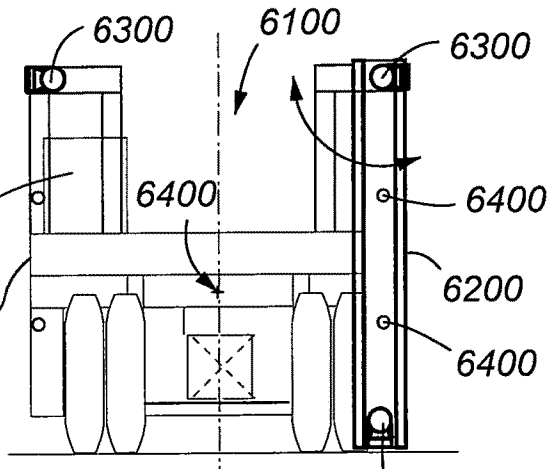
FIG. 62 is a cross sectional view of the deployed safety trailer of FIG. 61.
Figure 61:
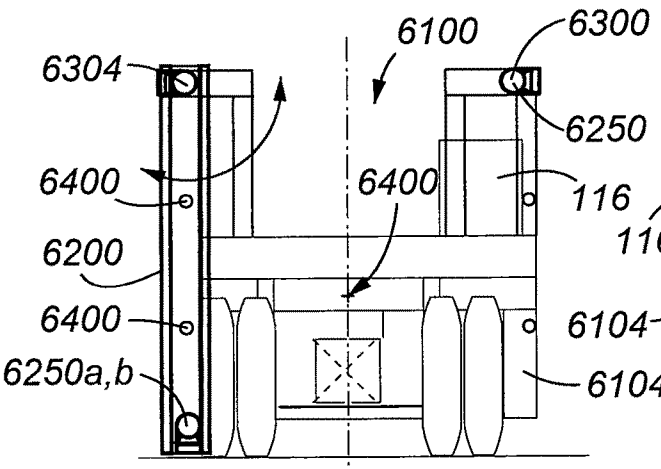
FIG. 61 is a cross section view of a deployed safety trailer taken along line 61-61 of FIG. 63 according to an embodiment.
Figure 72:
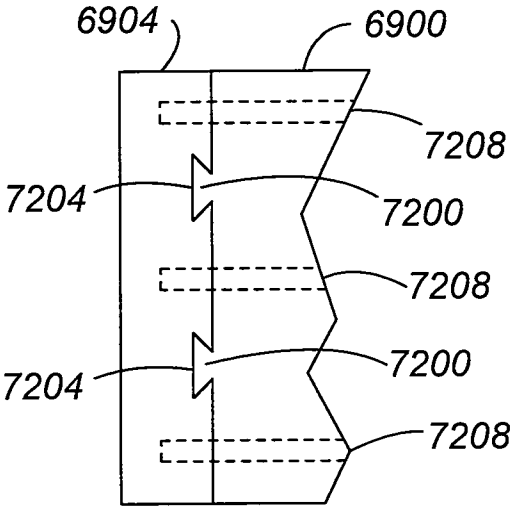
FIG. 72 is a cross sectional view of an interface between a safety wall segment and another safety wall segment according to an embodiment.
Figure 73:
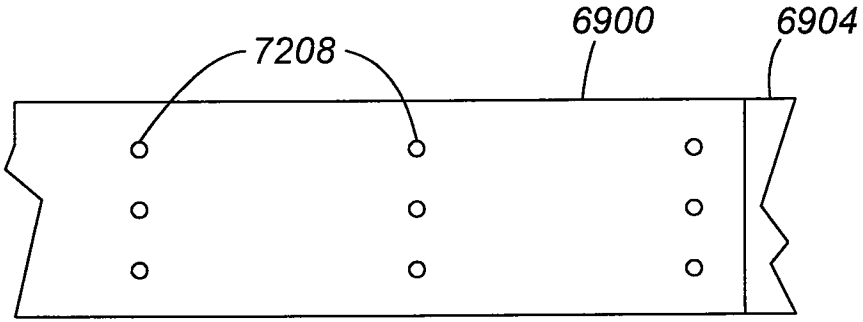
FIG. 73 is a rear view of a locking mechanism between two expandable and retractable safety wall members according to an embodiment.

FIGS. 59-60 and 72 depict a safety trailer according to an embodiment of this design. The safety trailer 5100 includes first and second platforms 5904 and 5908 and safety wall 5912 positioned between, and engaged with, the first and second platforms 5904 and 5908. First and second segments 6000 and 6904 of the safety wall 5912 are interconnected by a matching tongue 7200 and groove 7204 mechanism as shown in FIG. 72. This mechanism permits the first and second segments 6000 and 6904 to move linearly, in the directions shown, relative to one another. In one configuration, independently operable brakes on the second platform are activated to hold the second platform stationary while the first platform is moved in the direction shown. When the safety wall 5912 is extended to the desired degree, dowels are inserted into holes 7208 passing from a backside of and through the safety wall segment 6900 and into the safety wall segment 6904. In this manner, the dowels are inserted and removed from the protected work area. In one configuration, the wall length is adjustable by positioning a plurality of holes 7208 at selected intervals along a length of the safety wall 5912, as shown in FIG. 73. In this manner, the safety wall is moved to the desired position, the holes in the wall segments 6900 and 6904 aligned, and dowels placed in the aligned holes. The edge 6040 may be beveled to reduce the likelihood of the edge becoming a snag to an impacting vehicle.

Figure 65:
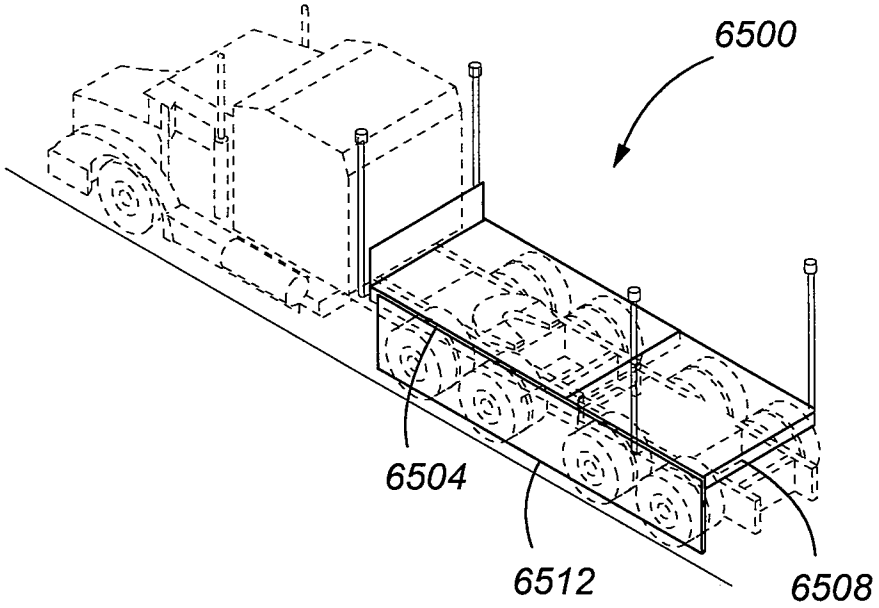
FIG. 65 is an isometric view of an undeployed safety trailer according to an embodiment.
Figure 66:
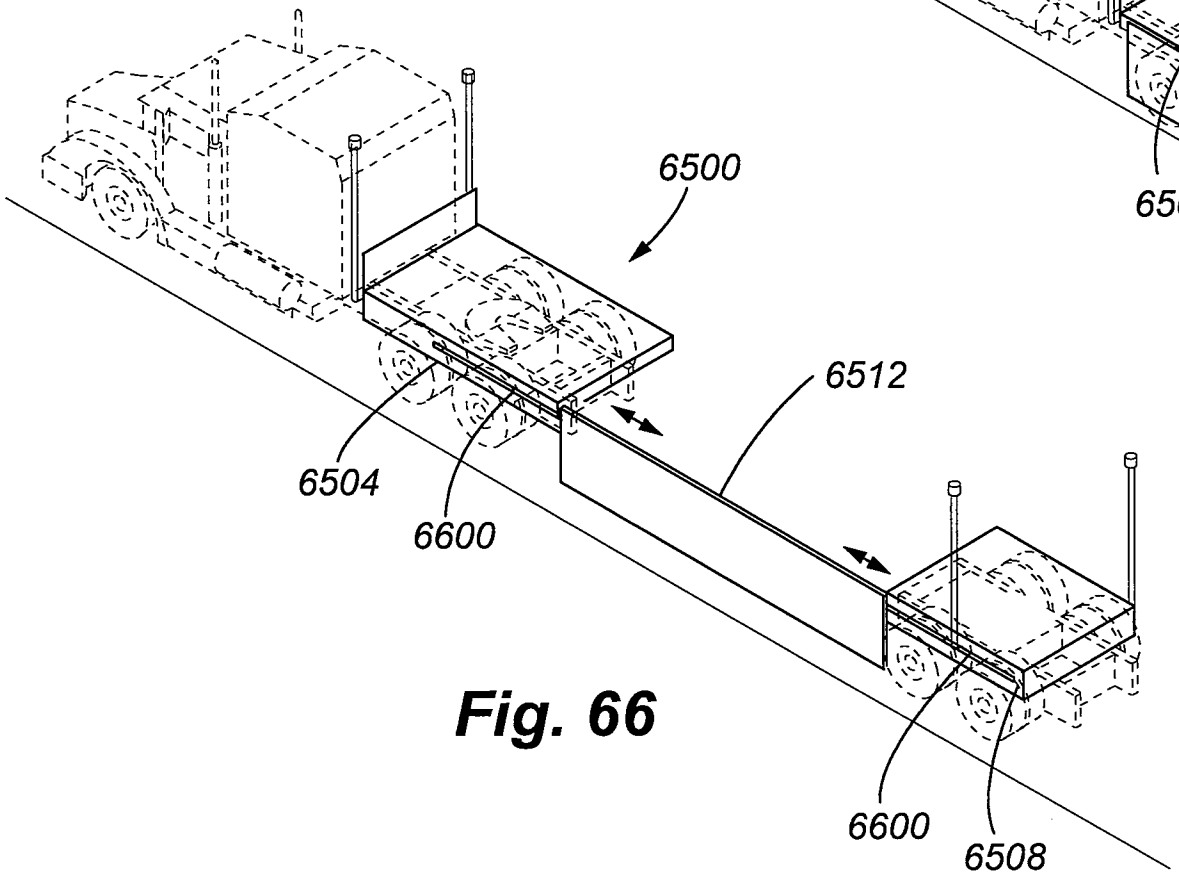
FIG. 66 is an isometric view of the deployed safety trailer of FIG. 65.

FIGS. 65-66 depict a safety trailer according to an embodiment of this design. The safety trailer 6500 includes first and second platforms 6504 and 6508 and safety wall 6512 positioned between, and engaged with, the first and second platforms 6504 and 6508. The safety wall 6512 is secured to the first and second platforms by a matching tongue (not shown) and groove 6600 mechanism, such as that shown in FIG. 72. This mechanism permits the first and second platforms, when moved apart, to move, relatively to the safety wall 6512, linearly, in the directions shown. In one configuration, independently operable brakes on the second platform are activated to hold the second platform stationary while the first platform is moved in the direction shown.

Figure 67:
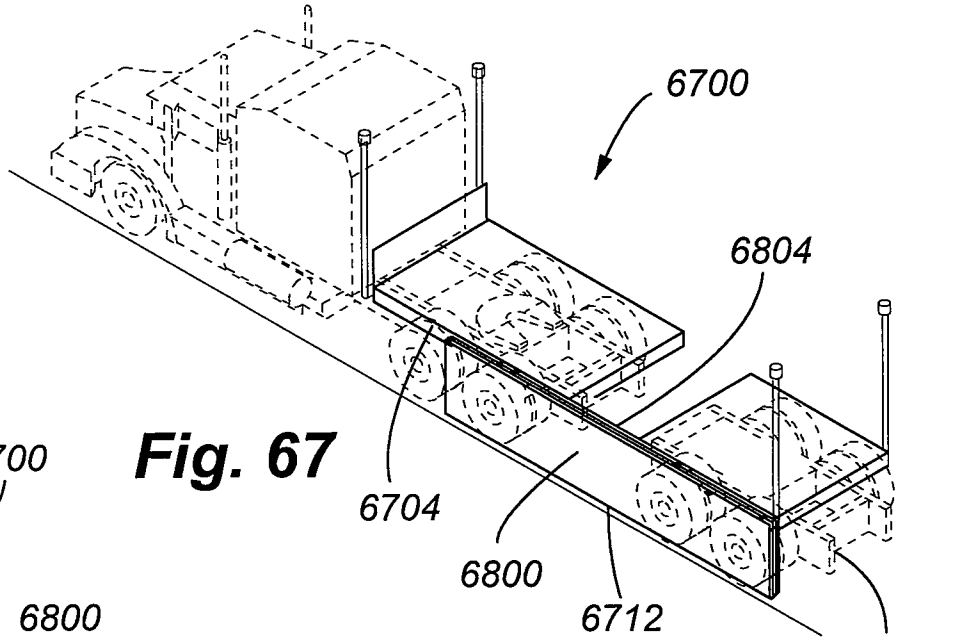
FIG. 67 is an isometric view of an undeployed safety trailer according to an embodiment.
Figure 68:
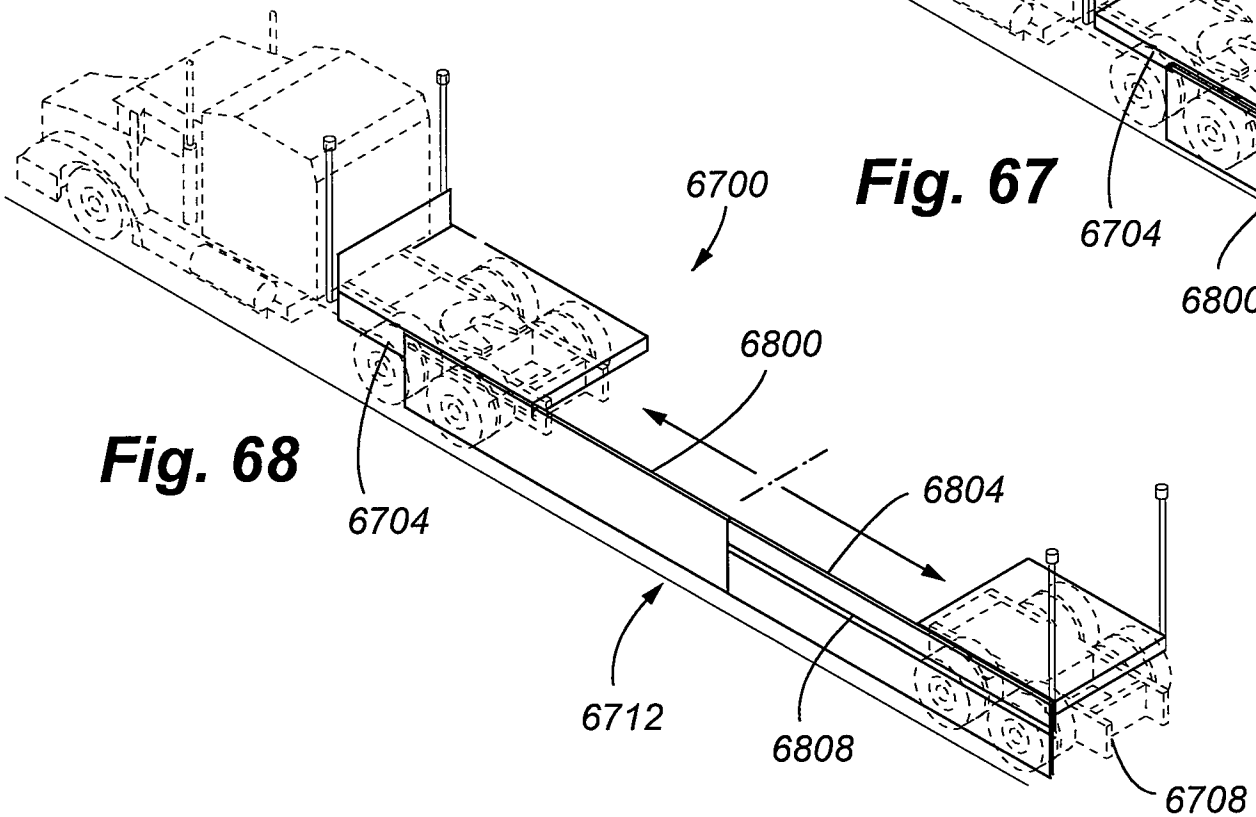
FIG. 68 is an isometric view of a deployed safety trailer of FIG. 67.

FIGS. 67-68 depict a safety trailer according to an embodiment of this design. The safety trailer 6700 includes first and second platforms 6704 and 6708 and safety wall 6712 positioned between, and engaged with, the first and second platforms 6704 and 6708. First and second segments 6800 and 6804 of the safety wall 6712 are interconnected by a matching tongue 6808 and groove mechanism, such as that shown in FIG. 72. This mechanism permits the first and second segments 6800 and 6804 to move linearly, in the directions shown, relative to one another. The first and second segments 6800 and 6804, while being movably (slidably) engaged relative to one another, are each fixidly or permanently engaged to a corresponding adjacent one of the first and second platforms 6704 and 6708. In one configuration, independently operable brakes on the second platform are activated to hold the second platform stationary while the first platform is moved in the direction shown.

Safety Wall Structural Designs

A variety of safety wall structural designs will now be described. All of the designs shall be described with reference to a latitudinal cross section through the safety wall. These designs may be used for any of the safety walls discussed above.

Figure 41:
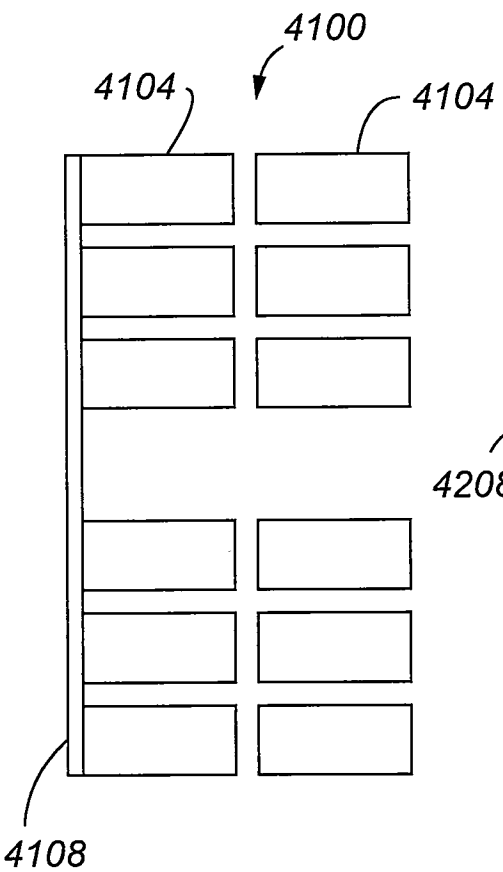
FIG. 41 is a side view of a safety wall according to an embodiment.

Referring to FIG. 41, a safety wall 4100 according to an embodiment includes a plurality of spaced apart structural members 4104 extending into the page, with an outer skin 4108. The outer skin 4108 faces traffic and provides the planar surface to direct impacting vehicles away from the protected area, located interiorly of the wall 4100. The members 4104 define a two-dimensional matrix having multiple columns and rows of members. At each end of wall, an end plate (not shown) is connected to the members 4104. As will be appreciated, the number and positioning of the members 4104 depend on the unique specifications and requirements of the application.

Figure 42:
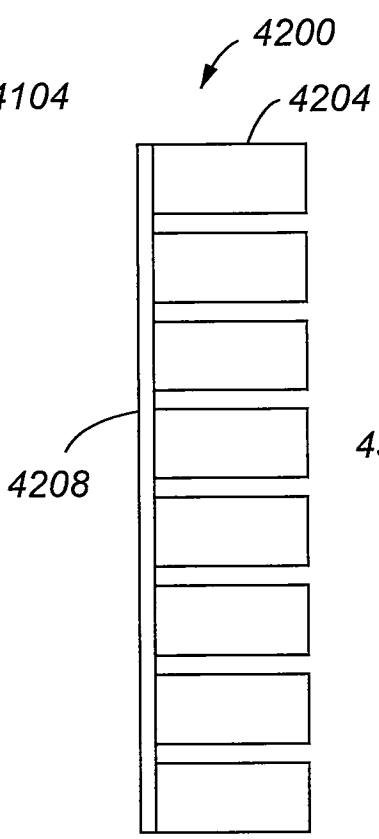
FIG. 42 is a side view of a safety wall according to an embodiment.

FIG. 42 depicts another safety wall embodiment. Unlike the embodiment of FIG. 41, the safety wall 4200 includes a single row of spaced apart structural members 4204 supporting an outer skin 4208.

Figure 43:
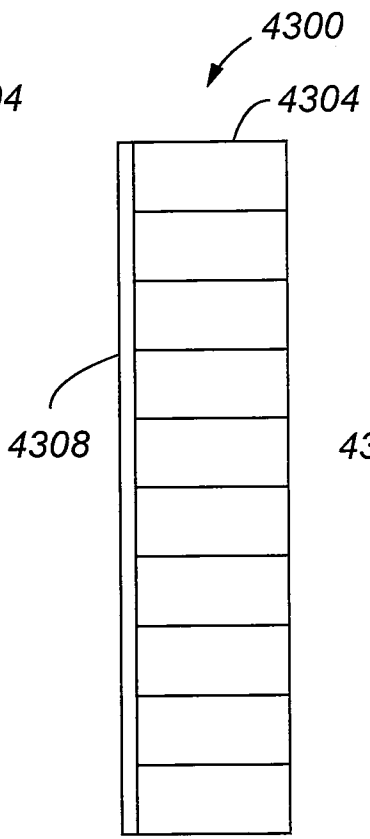
FIG. 43 is a side view of a safety wall according to an embodiment.

FIG. 43 depicts another safety wall embodiment. Unlike the embodiment of FIG. 42, the safety wall 4300 includes a single row of interconnected structural members 434 supporting an outer skin 4308.

Figure 44:
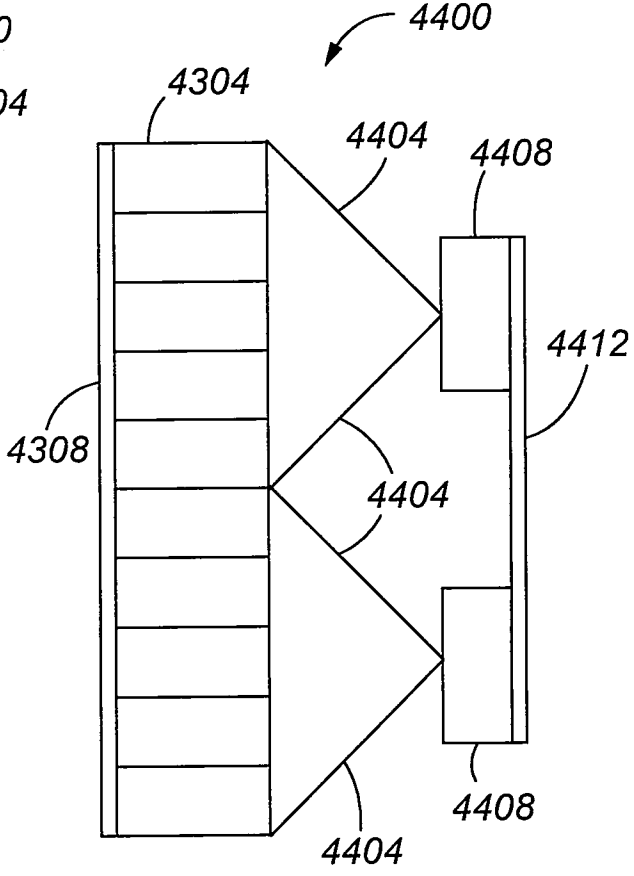
FIG. 44 is a side view of a safety wall according to an embodiment.

FIG. 44 depicts yet another safety wall embodiment. The safety wall 4400 includes the structural members 4304 and outer skin 4308 of FIG. 43 but further includes force channeling members 4404, structural members 4408, and interior skin 4412 to dissipate any impacting force applied to the outer skin 4308. As will be appreciated, the force channeling members 4404, in one configuration, are gussets that direct some of the impacting force to the structural members 4408 and interior skin 4412.

Other safety wall configurations may also be employed. By way of example, the safety wall configuration disclosed in copending U.S. application Ser. No. 12/533,931, filed Jul. 31, 2009; Ser. No. 12/347,458, filed Dec. 31, 2008; and Ser. No. 12/347,467, filed Dec. 31, 2008, each of which is incorporated herein fully by this reference. As will be appreciated, other features disclosed in these applications may be applied to any of the embodiments disclosed herein.

Other Features

Figure 55:
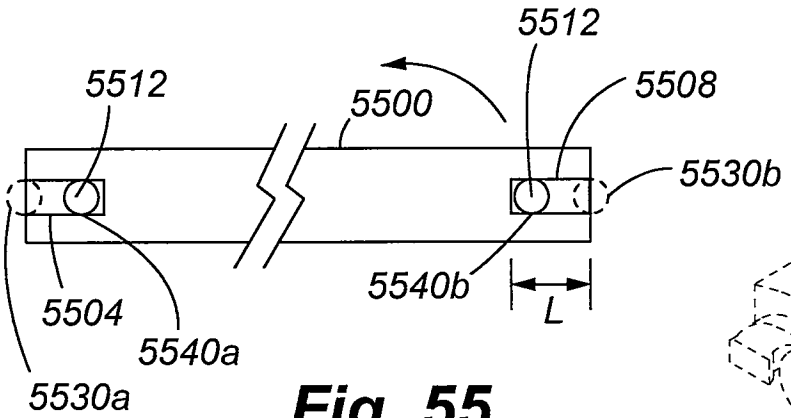
FIG. 55 is a safety wall according to an embodiment.

FIG. 55 shows that a configuration of a safety wall 5500 that may be used with any of the above embodiments. Each end of the safety wall 5500 includes first and second elongated slots 5504 and 5508 at either end of the safety wall 5500. The slots 5504 and 5508 receive a corresponding pin 5512, which engages a corresponding one of the first and second platform. In the configuration shown, a pair of dowels 5520 is positioned between each end of the safety wall 5500 and a respective one of the first and second platforms. When the safety wall is not deployed, the dowels 5520 are in first positions 5530*a,b* and, when the safety wall is deployed, one set of the dowels 5520 nearest one edge is removed so that the other set of dowels 5520 become the axis of rotation of the safety wall, as discussed above. As the safety wall approaches a vertical orientation, the unremoved set of dowels 5520 move to second positions 5540*a* or *b*. The length "L" of each slot determines a length of "drop" of the wall when the wall is deployed to a vertical orientation. In other words, if the length "L" is 2 feet, the pair of dowels on the lower edge of the deployed safety wall will move into the second position 5540*a* (assuming that edge 5550 is the lower edge and edge 5560 is the upper edge), causing the wall to move downwardly 2 feet.

Figure 79:
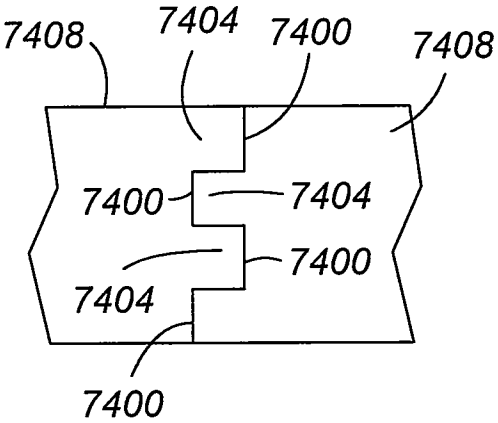
FIG. 79 is an isometric view of the safety trailer according to the embodiment.
Figure 78:
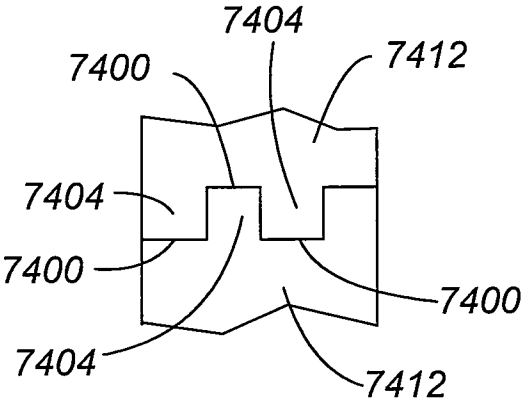
FIG. 78 is a cross section view taken along line 74-74 of FIG. 76 showing a safety trailer according to the embodiment.
Figure 77:
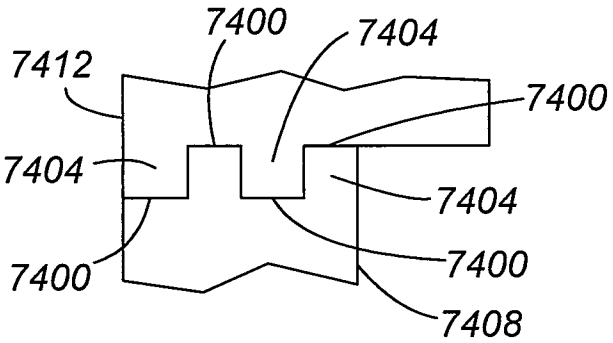
FIG. 77 is a cross section view taken along line 74-74 of FIG. 76 showing a safety trailer according to another embodiment.

FIGS. 74-76 depict various interlocking mechanisms that may be used with any of the above embodiments. FIG. 74 depicts an interlocking set of grooves 7400 and teeth 7404 at the interface between a safety wall 7408 and platform 7412. The interlocking set of grooves and teeth can not only provide structural strength to the interface but also provide a guide mechanism to align the safety wall 7408 and platform 7412. FIG. 75 shows the same interlocking mechanism used at the interface between two platforms when the safety wall is not deployed. In other words, when the safety wall is removed and the two platforms connected, the platform interfaces at either end of the wall are reverse images of each other, thereby permitting them to interlock to provide additional structural strength to the trailer. Thus, either end of the safety wall will have teeth and grooves that are also reverse images of each other to permit them to interlock with the opposing platforms. FIG. 76 shows a similar interlocking mechanism for two adjoining safety wall segments. As will be appreciated, the mechanisms of FIGS. 77-79 can also act as guide mechanisms to asset in positioning or aligning the adjacent safety wall segments, platform and safety wall, or platforms in a desired orientation relative to one another.

Figure 32:
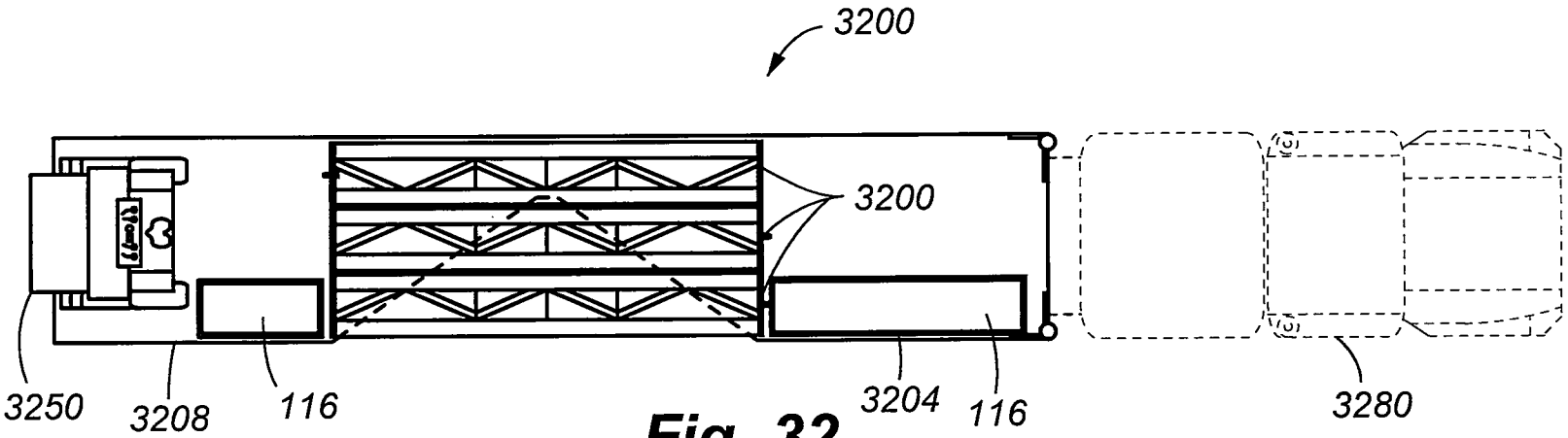
FIG. 32 is a plan view of an undeployed safety wall with an asphalt roller-equipped second platform according to an embodiment.

FIG. 32 depicts a safety trailer 3200 having a heavy roller 3250 on a second (rear) platform 3208. The heavy roller 3250 may be used in lieu of or in addition to rubber tires. In one configuration, the rubber tires (not shown) are elevated above the road surface when the roller 3250 is in use (or in contact with the road surface), and the roller 3250 is elevated above the road surface when the rubber tires are in use (or in contact with the road surface). This may be effected, for example, by a hydraulically actuated mechanism as will be appreciated by those of ordinary skill in the art. The safety wall members 3220, which are interconnected with one another and with the first and second platforms 3204 and 3208 are positioned on the bed defined by the first and second platforms. This safety wall embodiment is discussed in the various copending U.S. applications referenced above. When the safety wall is positioned between the first and second platforms 3204 and 3208, the tractor 3280 pulls the safety trailer forward to provide a movable protected work area. The roller 3250 is lowered by engage the road surface in this mode. For asphalting operations in which hot asphalt decreases substantially the operational life of rubber tires, this configuration is of particular benefit. Additionally, the heavy roller 3250 can eliminate the need for a separate machine to compress the as applied asphalt.

Figure 33:
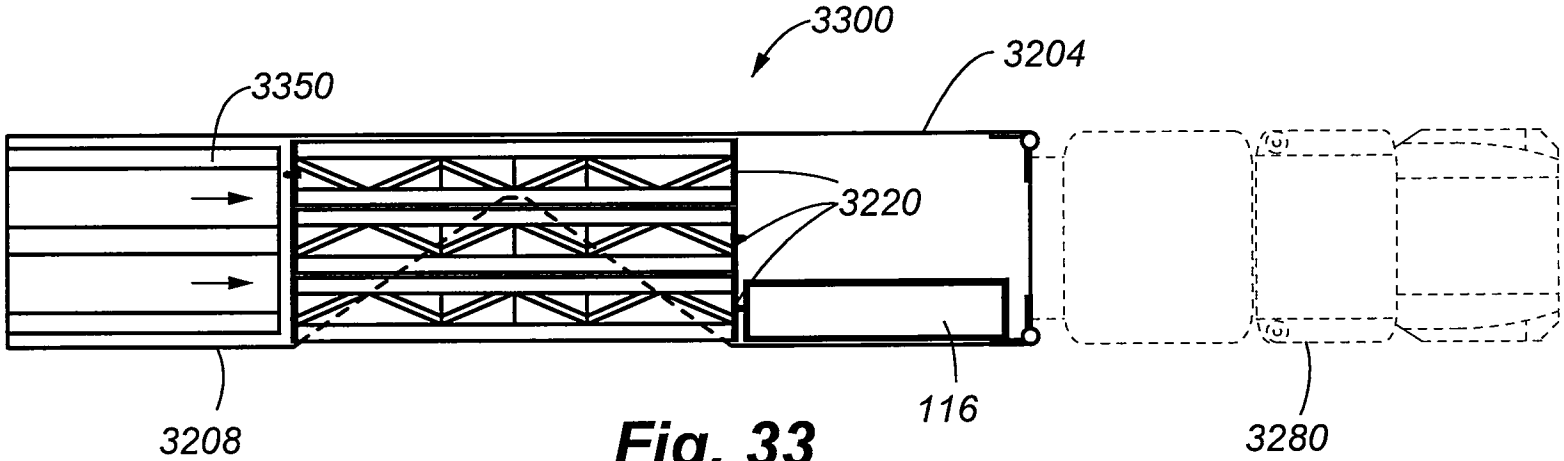
FIG. 33 is a plan view of an undeployed safety wall with a side dump-equipped second platform according to an embodiment.

FIG. 33 depicts a safety trailer according to another embodiment. The safety trailer 3300 includes an aggregate director 3350 to direct aggregate materials, such as dirt, gravel, and concrete into the protected work area, when the safety wall is in position. Examples of aggregate directors include hydraulically actuatable front dumps (which dump material forwardly rather than rearwardly or to the side), concrete chutes, concrete mixer, conveyors, and the like.

Any of the above trailer configurations and embodiments can have one or both of the platforms configured to include a rear caboose, as disclosed by U.S. Pat. No. 7,572,022, which is incorporated herein by this reference.

A number of variations and modifications of the invention can be used. It would be possible to provide for some features of the invention without providing others.

For example in one alternative embodiment, the features of the above embodiments may be combined with the features of other embodiments disclosed above.

In another alternative embodiment, the truck or tractor is incorporated into the safety trailer to provide a mechanized vehicle having a permanently connected safety wall. In this embodiment, the truck or tractor is not removably hitched to a safety trailer.

Figure 80:
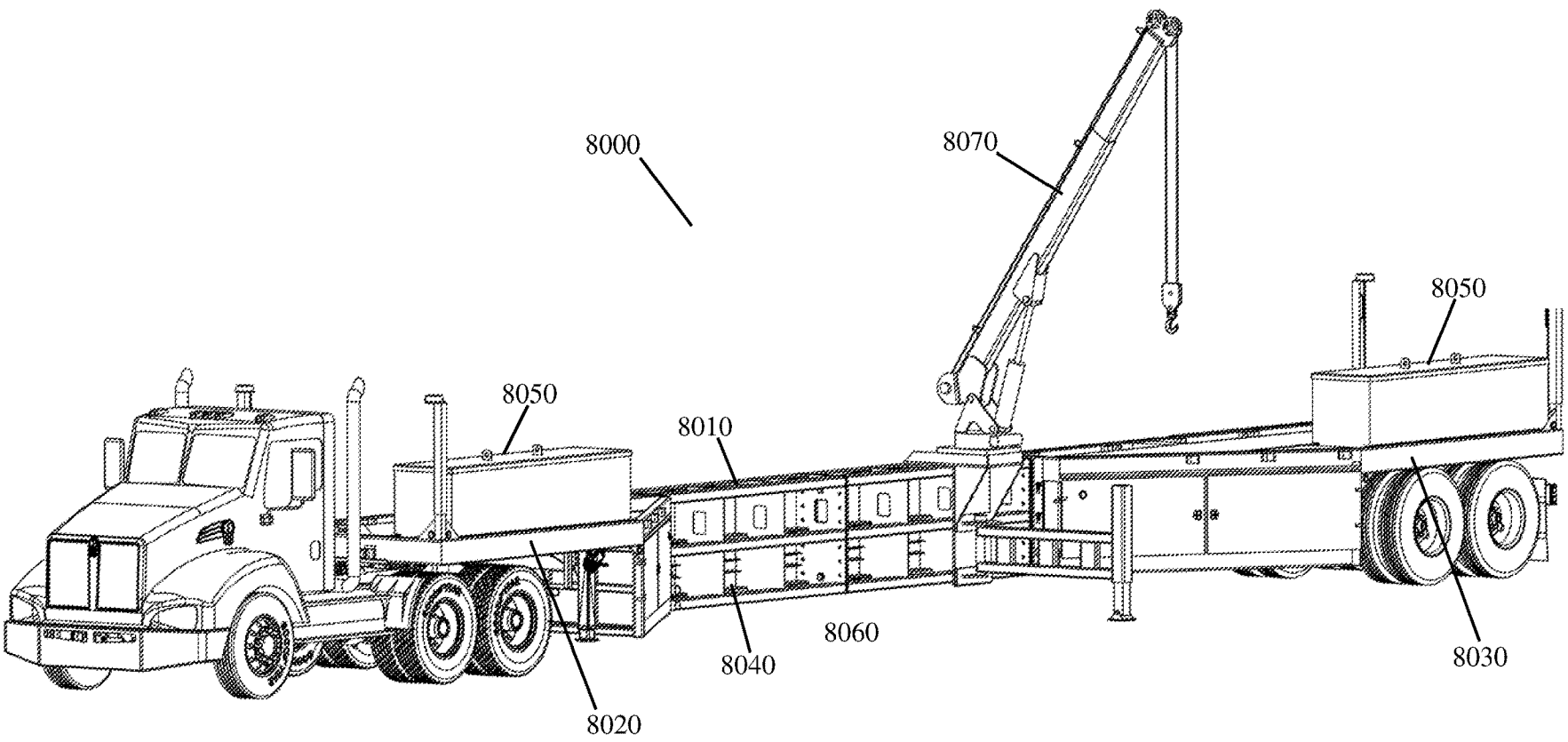
FIG. 80 is an isometric view of the safety trailer according to an embodiment.

FIG. 80 shows an alternate embodiment for the safety trailer. FIG. 80 is a view similar to the embodiment shown in FIGS. 51-58. As in FIG. 80, the trailer 8000 is shown in its unloaded or deployed configuration. The wall section 8010 has been removed from the loaded positions on top of the platforms 8020 and 8030 and connected between the platforms 8020 and 8030 to form a protective barrier 8040. As can be seen in FIG. 80, the two ballast boxes 8050, moveable along a fixed path, are placed on top of the platforms 8020 and 8030. The ballast boxes provide a counter-balance to the weight of the wall section 8010, which is disposed on the opposite side of the platforms 8020 and 8030. FIG. 80 shows a view of the safety trailer 8000 from the perspective of the protected work zone area. As can be seen, the safety trailer creates a protected work area 8060, which includes a space adjacent to the wall section 8010 and between the platforms 8020 and 8030. The road or other work surface is exposed within the work zone area 8060. In the embodiment shown in FIG. 80, a crane with a hook 8070 is shown for lifting the wall section 8010 from the platforms 8020 and 8030 during assembly.

The present invention, in various embodiments, configurations, or aspects, includes components, methods, processes, systems and/or apparatus substantially as depicted and described herein, including various embodiments, configurations, aspects, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A safety trailer comprising:

first and second platforms, each of the first and second platforms having at least one axle and at least one set of wheels;

upper and lower safety wall portions, positioned between and engaged with the first and second platforms, each of said upper and lower safety wall portions having first and second segments and a mechanism that permits the first and second segments to move linearly relative to one another in the direction of the length of the safety trailer, thereby increasing and decreasing telescopic engagement of the first and second segments;

wherein the upper and lower safety wall portions are further slidingly engaged with the first and second platforms so that the upper and lower safety wall portions may translate linearly side-to-side between left and right sides of the safety trailer depending on an orientation of the safety trailer relative to oncoming traffic; and wherein the first and second segments of the upper and lower safety wall portions are interconnected by a matching tongue and groove mechanism.

2. The safety trailer of claim 1, wherein the upper and lower safety wall portions are moved side-to-side by first and second motors.

3. The safety trailer of claim 2, wherein the first and second motors are positioned on either side of the upper and lower safety wall portions.

4. The safety trailer of claim 2, wherein the first and second motors are positioned inside of the first and second platforms.

5. The safety trailer of claim 2, wherein the first and second motors each turn a respective gear to move the safety wall in a channel.

6. The safety trailer of claim 1, wherein independently operable brakes on the second platform are activated to hold the second platform stationary while the first platform is moved to thereby move the first and second segments of the upper and lower safety wall portions linearly relative to one another in the direction of the length of the safety trailer.

7. The safety trailer of claim 1, wherein the upper and lower safety wall portions are moved side-to-side by a linear translation mechanism that includes a channel member on the first and second platforms and a roller assembly including a roller that rolls from side-to-side in the channel.

8. The safety trailer of claim 1, wherein the first and second segments of the upper and lower safety wall portions are moved linearly relative to one another by a hydraulic cylinder.

9. The safety trailer of claim 1, wherein the first and second segments of the upper and lower safety wall portions have a rectangular cross section.

10. The safety trailer of claim 1, wherein the upper and lower safety wall portions may be positioned on separate sides of the safety trailer to define a fully protected and enclosed work space.

* * * * *